US012635769B2

(12) United States Patent
Dananberg et al.

(10) Patent No.: US 12,635,769 B2
(45) Date of Patent: May 26, 2026

(54) CLEATED FOOTWEAR

(71) Applicant: HBN SHOE, LLC, Salem, NH (US)

(72) Inventors: Howard Dananberg, Stowe, VT (US); Brian G. R. Hughes, San Antonio, TX (US)

(73) Assignee: HBN SHOE, LLC, Salem, NH (US)

( * ) Notice: Subject to any disclaimer, the term of this patent is extended or adjusted under 35 U.S.C. 154(b) by 0 days.

(21) Appl. No.: 19/224,243

(22) Filed: May 30, 2025

(65) Prior Publication Data

US 2025/0288061 A1 Sep. 18, 2025

Related U.S. Application Data

(63) Continuation-in-part of application No. 19/070,030, filed on Mar. 4, 2025, which is a continuation-in-part of application No. 18/117,309, filed on Mar. 3, 2023.

(60) Provisional application No. 63/319,595, filed on Mar. 14, 2022.

(51) Int. Cl.
*A43C 15/16* (2006.01)

(52) U.S. Cl.
CPC ..... *A43C 15/161* (2013.01); *A43C 15/162* (2013.01)

(58) Field of Classification Search
CPC ..... A43C 15/161; A43C 15/162
See application file for complete search history.

(56) References Cited

U.S. PATENT DOCUMENTS

| | | | | |
|---|---|---|---|---|
| 3,327,411 | A * | 6/1967 | Roberts | A43C 15/167 36/134 |
| 6,101,746 | A * | 8/2000 | Evans | A43C 15/162 36/134 |
| 2008/0222921 | A1* | 9/2008 | Gerber | A43B 3/0042 36/103 |
| 2009/0307925 | A1* | 12/2009 | Pfister | A43B 7/223 36/43 |
| 2017/0196305 | A1* | 7/2017 | Barnes | A43B 5/06 |

* cited by examiner

*Primary Examiner* — Uyen T Nguyen
(74) *Attorney, Agent, or Firm* — HAYES SOLOWAY P.C.

(57) ABSTRACT

A cleated shoe has an upper, a Strobel board or midsole, and an outsole having a plurality of cleats, assembled to the upper/Strobel board or midsole. The insole has a first forefoot region configured to underlie heads of the second through fifth metatarsal bones of a wearer, and a second forefoot region having a concave depression extending downward from a top of the insole and is configured to underlie a head of the first metatarsal bone of the wearer. A hollow is provided in the Strobel board or midsole underlying the concave depression of the insole, and a corresponding concave depression is provided in the outsole underlying the concave depression of the insole and the hollow in the Strobel board or the midsole. The cleats are radially arranged around the head of the first metatarsal bone of the wearer.

28 Claims, 29 Drawing Sheets

CLEATED FOOTWEAR

CROSS REFERENCE TO RELATED APPLICATION

This application is a continuation-in-part (CIP) application of U.S. application Ser. No. 19/070,030, dated Mar. 4, 2025, which application is a continuation-in-part (CIP) application of co-pending U.S. application Ser. No. 18/117,309, filed Mar. 3, 2023, which application in turn claims priority to U.S. Provisional Application Ser. No. 63/319,595, filed Mar. 14, 2022, the contents of which are incorporated herein by reference.

FIELD OF THE DISCLOSURE

The present disclosure is generally related to footwear. The disclosure has particular utility in connection with sports footwear such as soccer footwear having a hard, one-piece, molded outsole and will be described in connection with such utility, although other utilities are contemplated.

BACKGROUND AND SUMMARY

The present disclosure relates to new designs for cleated, studded or spiked athletic shoes. The disclosure has particular applicability to cleated soccer footwear or so-called "soccer shoes" or "soccer boots" and will be described in connection with such utility, although the disclosure also may be advantageously used with other cleated, studded or spiked footwear including, but not limited to cricket shoes, football boots, baseball shoes, track shoes, rugby shoes and the like. The disclosure also advantageously may be used with cleated, studded or spiked footwear subject to unidirectional or asymmetric rotational motion such as golf shoes and sport shoes for shot put, discus, javelin, and the like.

Athletic shoes are a combination of many elements which have specific functions, all of which must work together for the support and protection of the wearer's foot during an athletic event. Cleated, studded or spiked athletic shoes, particularly soccer boots, typically include an upper which is assembled or bonded to a Strobel board or midsole, a removable insole over the Strobel board or midsole and a cleated, studded or spiked outsole. The outsole provides traction, protection, and a durable wear surface.

The sport of soccer imposes special demands upon player footwear. To begin with, players run long distances. In a 90 minute match, a player may run as much as (or more than) 14 kilometers (over 8.5 miles). When practice sessions are also considered, a player may run in excess of 70 kilometers (43.5 miles) per week while wearing soccer boots. It is thus important that soccer boots protect and support the foot while minimizing discomfort.

The presence of cleats, studs or spikes on a shoe or boot outsole presents additional problems in this regard. Specifically, cleats, studs or spikes can cause point pressures on a player's foot, particularly when the player is running over a hard playing field. Moreover, the long distances that a player must run, in combination with the side-to-side motions, foot-planting motions (for kicking a ball) and other common motions, can cause a player to become even more fatigued and injury prone than the player might be from simply running. As used herein the terms "cleat", and "cleated" shall be understood to mean cleats, studs, pins and spikes unless otherwise stated.

Pronation, or the rolling of a foot from the outside to the inside during running, is of special interest. In particular, pronation occurs as a runner's foot strikes the ground on the outside (or lateral) edge of the foot and the foot then rolls inward so as to place the inner (or medial) edge on the ground. A certain amount of pronation is natural and necessary for normal running. Pronation is considered abnormal when it occurs in the $2^{nd}$ half of the support phase of the step. Since this phase is consistent with the period when the heel is rising, then anything which impacts the ability of the heel to lift (i.e., lost motion of the metatarsophalangeal joints) can create an environment in which the foot must excessively pronate as an accommodation to restriction of heel lift.

The anterior cruciate ligament (ACL) is one of the main ligaments in the knee which connects the thigh bone (femur) to the shinbone (tibia) and helps to stabilize the knee, resisting internal rotation of the tibia and compression between the tibia and the femur. Twenty percent of all sports-related knee injuries involve the ACL. A large proportion of these ACL injuries occur in non-contact scenarios, usually during rapid decelerations or landing movements where the plantar surface of the foot is fixed to the playing surface and relative rotation occurs between the upper and lower leg.

In soccer, cleats are primarily designed to provide traction on soft ground where flat-bottom shoes are prone to slippage. Cleats are necessary from a performance perspective, as athletes need some mechanism that resists slipping in order to accelerate and decelerate quickly on the pitch. However, research has shown that increased traction between shoes and the ground create reaction forces which are transmitted to the knee and lead to increased risk of ACL injury. Further, it is believed that certain cleat designs which resist the twisting motion of the planted foot increase the risk of ACL injury by transmitting torsional forces to the knee during high-risk loading scenarios.

That is to say, in the case of cleated footwear, there is a "mismatch" between traction and available rotation during running, stopping, and changing direction. Non-contact injuries to the knee are a major issue in sports, particularly soccer, where stopping abruptly and changing direction causes excessive rotational stress on the cruciate ligament in the knee. Rupture of this structure is unfortunately common.

Additionally, the presence of a cleat directly under the wearer's first metatarsal head inhibits flexing of the foot by locking the wearer's first metatarsal head joint, which in turn essentially locks the wearer's heel to the ground, increasing the risk of knee damage caused by the wearer's foot being unable to rotate around the first metatarsal head.

The present disclosure addresses the foregoing problems and other problems of the prior art by providing cleated footwear that controls motion of the wearer's foot, increases comfort and reduces fatigue, while also reducing stress by permitting normal foot joint flexibility while simultaneously maintaining traction while running, stopping and changing direction.

Cleated footwear normally is fabricated with cleated protrusions extending from the bottom outward towards the field surface. When cleats are placed directly under the first metatarsal head (which is traditional), they create an upward force on the wearer's first metatarsal head, causing the first metatarsal phalangeal joint (toe joint) to either reduce its ability to plantarflex and evert, or causes the first metatarsal phalangeal joint to lock up during the loading phase of running.

To facilitate both traction and flexibility, and also reduce stress on the cruciate ligament of the knee, in accordance with one embodiment of our disclosure, we provide cleated footwear comprising an outsole having a cleated essentially rigid forefoot region and a cleated essentially rigid heel region with a cleat-free mid-section or region underlying the first through fifth metatarsal heads positioned therebetween. A specially shaped depression or inverted dome is formed extending downward from the top of the cleat-free mid-section or region and is configured to lie directly under the first metatarsal head of the wearer. The shape of this depression or inverted dome preferably is not simply round, but instead of oblique orientation, so as to permit the first metatarsal head of the wearer to lower or plantarflex and evert while under load, i.e., in accordance with the teachings of prior U.S. Pat. No. 8,166,674 the contents of which are incorporated herein by reference. Since this depression or inverted dome is concave facing upwards and convex facing downward, a convex surface is surrounded by cleats extending outward from the outsole, where several cleats are radially arranged along the edges of the convex surface. Depending on the playing surface (i.e., grass or turf), the cleats may be made longer for grass or shorter for artificial turf so that the total of them will be flat on any given surface. However, the mid-section or region including the area configured to underlie the first metatarsal head of the wearer is devoid of cleats, i.e., to decouple the metatarsals plantarflexion motion from the upward force (dorsiflexion) created by a traditional cleat design.

Also, in order to maximize linear force while minimizing rotational force, we shape our cleats as truncated cones with a flat side which is essentially perpendicular to the bottom of the shoe or boot, and position the cleats on a lateral side of the forefoot region of the outsole with the flat side facing the lateral side of the forefoot region. We also locate three like cleats around a periphery of the inverted dome, with the flat side of the cleats facing the inverted dome, with two of the cleats positioned forward of the inverted dome, and the third cleat is located rearward of the inverted dome.

In addition to cleats surrounding the depression or inverted dome on the bottom of the outsole, we arrange a plurality, preferably four, similarly shaped cleats essentially on a radius extending from a center point of the depression or inverted dome, from the bottom of the shoe or boot. Two cleats are arranged in the toe region of the shoe or boot, with their flat side facing towards the depression or inverted dome, while two of the cleats are arranged along the outer lateral area of the shoe or boot, with their flat side facing outward. As so arranged the cleat configuration and shape promotes both forward and lateral traction and enhanced rotational motion.

Having a depression area underlying the first metatarsal head of the wearer permits the first metatarsal head to plantarflex and evert. This allows a decoupling of the upward ground force from plantarflexing the first metatarsal head without sacrificing traction provided by the cleat Also, the heel portion of conventional cleated footwear also may promote excessive traction and potential for injury. In accordance with another embodiment of the present disclosure, we provide a downwardly directed heel depression within the heel region of the shoe configured to essentially underlie the underside of the human calcaneus bone. Preferably the heel depression is a slightly larger depression under the medial tuberosity and a very subtly raised area under the lateral tuberosity, i.e., in accordance with the teaching of our prior U.S. Pat. No. 10,702,008, the contents of which are incorporated herein by reference. The bottom of the depression is provided with a plurality of cleats surrounding the bottom of the heel depression essentially on a radius emanating from a center of the heel depression. Additional cleats may be provided along the outer edge of the heel portion of the shoe, also within a prescribed radius with the center being a center point of the heel depression.

As described above, the cleats underlying the heel portion of the shoe are formed as truncated half cones with a flat side. However, the flat side of the cleats are all aligned facing forward, with one cleat adjacent a rear of the heel portion of the shoe rearward the heel depression, and the other two cleats arranged on a radius forward of the heel depression.

In one embodiment of the disclosure there is provided a cleated shoe comprising: an upper, a Strobel board or midsole assembled to the upper, and an outsole assembled or bonded to the assembled upper and Strobel board or midsole. The outsole has a plurality of cleats which are secured to or incorporated in the outsole. The insole has a first forefoot region configured to underlie heads of the second, third, fourth, and fifth metatarsal bones of a foot of a wearer, and a second forefoot region having a concave depression extending downward from a top of the insole configured to underlie a head of the first metatarsal bone of the foot of the wearer and configured to permit the head of the first metatarsal bone of the wearer to plantarflex and evert while under load. The insole concave depression extends as a convex surface below a bottom surface of the insole and into a corresponding area of reduced support in the Strobel board or midsole. The area of reduced support in the Strobel board or midsole may comprise an inverted dome, and area of reduced durometer or a hollow, preferably a through hole. Underlying the area of reduced support on the Strobel board or midsole and the concave depression of the insole is a corresponding concave depression in the outsole. The concave depression of the outsole extends as a convex surface below a bottom surface of the outsole.

In one embodiment, the plurality of cleats are radially arranged about the convex surface of the outsole.

In another embodiment, the plurality of cleats are radially arranged about a second convex surface of the outsole, the second convex surface positioned at a heel region of the outsole.

In a further embodiment, the insole and the Strobel board or midsole and the outside each have a heel region having a concave heel depression configured to underlie an underside of the wearer's calcaneus bone.

In yet another embodiment, the outsole comprises a heel region which has the plurality of cleats radially arranged about a convex surface of the outsole of the forefoot region.

In such embodiment, the concave heel depression extends as a second convex surface of the outsole at a heel region, the heel region having the plurality of cleats radially arranged about the second convex surface of the outsole.

In still another embodiment, the outsole comprises a flex channel positioned posterior to the forefoot region.

In a further embodiment, the left shoe and the right shoe are left and right mirror images of one another.

In such embodiment, the shoes are selected from the group consisting of baseball shoes, cricket shoes, football boots, soccer boots, rugby shoes and track shoes.

In such embodiment, one of the left or the right shoes has a first plurality of cleats of the plurality of cleats radially arranged about the convex surface of the forefoot region of the outsole and a second plurality of cleats of the plurality of cleats positioned at a heel region of the outsole, wherein the second plurality of cleats are radially arranged about the convex surface of the forefoot region of the outsole.

In a further embodiment, one of the left or the right shoes has a first plurality of cleats of the plurality of cleats positioned at the forefront of the outsole and radially arranged about a second convex surface of the outsole, the second convex surface positioned at a heel region of the outsole and a second plurality of cleats of the plurality of cleats positioned on a heel region of the outsole, wherein the second plurality of cleats are radially arranged about the second convex surface of the outsole.

In such embodiment, the outsoles are different for left and right shoes.

In such embodiment, the plurality of cleats are arranged differently on the left and right shoes.

In such embodiment, the shoes are selected from the group consisting of golf shoes, discus shoes, javelin shoes and shot put shoes.

In such embodiment, a first plurality of cleats of the plurality of cleats is positionable on the forefoot region of the outsole; and a second plurality of cleats of the plurality of cleats is positionable on the heel region of the outsole.

In such embodiment, the first plurality of cleats and the second plurality of cleats are positionable on the forefoot region of the outsole and on the heel region of the outsole, respectively.

In such embodiment, a first plurality of cleats of the plurality of cleats is positioned on the forefoot region of the outsole and radially arranged about the convex surface of the outsole, and a second plurality of cleats of the plurality of cleats positioned on a heel region of the outsole is radially arranged about a second convex surface of the outsole heel region.

The disclosure also provides a cleated shoe comprising: an upper, a Strobel board or midsole assembled to the upper, and an outsole assembled or bonded to the assembled upper and Strobel board or midsole. The outsole has a plurality of cleats which are secured to or incorporated in the outsole. The insole and outsole have a first concave depression at a forefoot region, while the Strobel board or midsole has an area of reduced support, aligned between the first concave depressions of the insole and the outsole. The first concave depression is configured to underlie a head of the first metatarsal bone of the foot of the wearer and configured to permit the head of the first metatarsal bone of the wearer to plantarflex and evert while under load. The first concave depression extends as a convex surface below a bottom surface of the outsole. The insole, Strobel board or midsole, and outsole also have a second concave depression at a heel region. The second concave depression is configured to underlie a calcaneus of the foot of the wearer. The second concave depression extends as a convex surface below a bottom surface of the outsole.

In such embodiments, the plurality of cleats comprises a first plurality of cleats positioned on the forefoot region of the outsole and a second plurality of cleats positioned on the heel region of the outsole, wherein each of the first plurality of cleats and the second plurality of cleats are radially arranged about the first convex surface of the outsole.

In another embodiment, the plurality of cleats comprises a first plurality of cleats positioned on the forefoot region of the outsole and a second plurality of cleats positioned on the heel region of the outsole, wherein each of the first plurality of cleats and the second plurality of cleats are radially arranged about the second convex surface of the outsole.

In yet another embodiment, the left shoe and the right shoe are left and right mirror images of one another.

According to Aspect A, there is provided a cleated shoe comprising: an upper, a Strobel board or midsole assembled to the upper, and an outsole assembled or bonded to the assembled upper and Strobel board or midsole, and having a plurality of cleats which are secured to or incorporated in the outsole, wherein the insole has a forefoot region, having a first forefoot region configured to underlie heads of the second, third, fourth, and fifth metatarsal bones of a foot of a wearer, and a second forefoot region having a first concave depression extending downward from a top of the insole configured to underlie a head of the first metatarsal bone of the foot of the wearer and configured to permit the head of the first metatarsal bone of the wearer to plantarflex and evert while under load, wherein the outsole is devoid of cleats in an area underlying the first concave depression in the insole, and wherein the insole first concave depression extends as a convex surface below a bottom surface of the insole and into an optional area of reduced support in the Strobel board or midsole, and wherein the area of reduced support of the Strobel board or midsole overlies an optional first concave depression in the outsole, wherein the optional first concave depression of the outsole extends as a convex surface below a bottom surface of the outsole.

In one embodiment of Aspect A, the plurality of cleats are radially arranged about the optional first convex surface of the outsole.

In another embodiment of Aspect A, the plurality of cleats are radially arranged about a second convex surface of the outsole, the second convex surface positioned at a heel region of the outsole.

In a further embodiment of Aspect A, the insole and the Strobel board or midsole comprise a heel region having a concave heel depression configured to underlie an underside of the wearer's calcaneus bone, wherein the concave heel depression extends as a second convex surface, below the bottom surface of the outsole at the heel region, the second convex surface positioned below a bottom surface of the Strobel board or midsole and into a corresponding concave heel depression in the outsole.

In a further embodiment of Aspect A, the outsole comprises a heel region which has the plurality of cleats radially arranged about the second convex surface of the outsole of the forefoot region.

In another embodiment of Aspect A, the concave heel depression extends as a second convex surface of the outsole at a heel region, the heel region having the plurality of cleats radially arranged about the second convex surface of the outsole.

In still another embodiment of Aspect A, the outsole comprises a flex channel positioned posterior to the first convex surface of the forefoot region.

In a further embodiment of Aspect A, the left shoe and the right shoe are mirror images of one another.

In yet another embodiment of Aspect A, the shoes are selected from the group consisting of baseball shoes, cricket shoes, football boots, soccer boots, rugby shoes and track shoes.

In a still further embodiment of Aspect A, spike or cleat patterns outsoles are different for left and right shoes, and wherein the shoes preferably comprise golf shoes, javelin shoes, discus shoes or shot put shoes.

In a further embodiment of the cleated shoe of Aspect A comprises a first plurality of cleats of the plurality of cleats positionable on the forefoot region of the outsole; and a second plurality of cleats of the plurality of cleats positionable on the heel region of the outsole.

In still yet another embodiment of Aspect A, the first plurality of cleats and the second plurality of cleats are positioned on the forefoot region of the outsole and on the heel region of the outsole, respectively.

In yet another embodiment of Aspect A, a first plurality of cleats of the plurality of cleats is positioned on the forefoot region of the outsole and radially arranged about the first convex surface of the outsole, and a second plurality of cleats of the plurality of cleats is positioned on a heel region of the outsole is radially arranged about a second convex surface of the outsole heel region.

According to Aspect B, there is provided a cleated shoe comprising: an upper, a Strobel board or midsole assembled to the upper, and an outsole assembled or bonded to the assembled upper and Strobel board or midsole, and having a plurality of cleats which are secured to or incorporated in the outsole, wherein the insole has a forefoot region, having a first forefoot region configured to underlie heads of the second, third, fourth, and fifth metatarsal bones of a foot of a wearer, and a second forefoot region having a first concave depression extending downward from a top of the insole configured to underlie a head of the first metatarsal bone of the foot of the wearer and configured to permit the head of the first metatarsal bone of the wearer to plantarflex and evert while under load, wherein the outsole is devoid of cleats in areas underlying the first, second, third, fourth and fifth metatarsal bones of the foot of the wearer, and wherein the insole first concave depression extends as a convex surface below a bottom surface of the insole and into an optional area of reduced support in the Strobel board or midsole, and wherein the area of reduced support of the Strobel board or midsole overlies an optional first concave depression in the outsole, wherein the optional first concave depression of the outsole extends as a convex surface below a bottom surface of the outsole.

In one embodiment of Aspect B, the plurality of cleats are radially arranged about the optional first convex surface of the outsole.

In another embodiment of Aspect B, the plurality of cleats are radially arranged about a second convex surface of the outsole, the second convex surface positioned at a heel region of the outsole.

In a further embodiment of Aspect B, the insole and the Strobel board or midsole comprise a heel region having a concave heel depression configured to underlie an underside of the wearer's calcaneus bone, wherein the concave heel depression extends as a second convex surface, below the bottom surface of the outsole at the heel region, the second convex surface positioned below a bottom surface of the Strobel board or midsole and into a corresponding concave heel depression in the outsole.

In a further embodiment of Aspect B, the outsole comprises a heel region which has the plurality of cleats radially arranged about the second convex surface of the outsole of the forefoot region.

In another embodiment of Aspect B, the concave heel depression extends as a second convex surface of the outsole at a heel region, the heel region having the plurality of cleats radially arranged about the second convex surface of the outsole.

In still another embodiment of Aspect B, the outsole comprises a flex channel positioned posterior to the first convex surface of the forefoot region.

In a further embodiment of Aspect B, the left shoe and the right shoe are mirror images of one another.

In yet another embodiment of Aspect B, the shoes are selected from the group consisting of baseball shoes, cricket shoes, football boots, soccer boots, rugby shoes and track shoes.

In a still further embodiment of Aspect B, spike or cleat patterns outsoles are different for left and right shoes, and wherein the shoes preferably comprise golf shoes, javelin shoes, discus shoes or shot put shoes.

In a further embodiment of the cleated shoe of Aspect B comprises a first plurality of cleats of the plurality of cleats positionable on the forefoot region of the outsole; and a second plurality of cleats of the plurality of cleats positionable on the heel region of the outsole.

In still yet another embodiment of Aspect B, the first plurality of cleats and the second plurality of cleats are positioned on the forefoot region of the outsole and on the heel region of the outsole, respectively.

In yet another embodiment of Aspect B, a first plurality of cleats of the plurality of cleats is positioned on the forefoot region of the outsole and radially arranged about the first convex surface of the outsole, and a second plurality of cleats of the plurality of cleats is positioned on a heel region of the outsole is radially arranged about a second convex surface of the outsole heel region.

According to Aspect C, there is provided a pair of left and right cleated shoes as above described, wherein one of the left or the right shoes has a first plurality of cleats of the plurality of cleats radially arranged about the first convex surface of the forefoot region of the outsole and a second plurality of cleats of the plurality of cleats positioned at a heel region of the outsole, wherein the second plurality of cleats are radially arranged about the first convex surface of the forefoot region of the outsole.

In one embodiment of Aspect C one of the left or the right shoes has a first plurality of cleats of the plurality of cleats positioned at the forefront of the outsole and radially arranged about a second convex surface of the outsole, the second convex surface positioned at a heel region of the outsole and a second plurality of cleats of the plurality of cleats positioned on a heel region of the outsole, wherein the second plurality of cleats are radially arranged about the second convex surface of the outsole.

In yet another embodiment of Aspect C one of the left or the right shoes has a first plurality of cleats of the plurality of cleats positioned at the forefoot of the outsole and radially arranged about the first convex surface and a second plurality of cleats of the plurality of cleats positioned on a heel region of the outsole and radially arranged about the second convex surface, and wherein the other of the left or the right shoe has a first plurality of cleats radially arranged about a second convex surface of the outsole, the second convex surface positioned on a heel region of the outsole and a second plurality of cleats positioned on a heel region of the outsole and radially arranged about the second convex surface of the outsole.

According to Aspect D, there is provided a cleated shoe comprising: an upper, a Strobel board or midsole assembled to the upper, and an outsole assembled or bonded to the assembled upper and Strobel board or midsole, and having a plurality of cleats which are secured to or incorporated in the outsole, a first concave depression in the insole configured to underlie a head of the first metatarsal bone of the foot of the wearer and configured to permit the head of the first metatarsal bone of the wearer to plantarflex and evert while under load, wherein the first concave depression extends as a convex surface below a bottom surface of the insole into an area of reduced support in the Strobel board or midsole;

wherein the outsole has a first concave depression configured to underlie the first concave depression in the insole and the area of reduced support in the Strobel board or midsole; wherein the outsole is devoid of cleats, in an area underlying the first concave depression; and a second concave depression in the insole and in the outsole at a heel region, wherein the second concave depression is configured to underlie a calcaneus of the foot of the wearer, wherein the second concave depression extends as a convex surface below a bottom surface of the outsole.

In one embodiment of Aspect D, the plurality of cleats comprises a first plurality of cleats positioned on the forefoot region of the outsole and a second plurality of cleats positioned on the heel region of the outsole, wherein each of the first plurality of cleats and the second plurality of cleats are radially arranged about the first convex surface of the outsole.

In another embodiment of Aspect D, the plurality of cleats comprises a first plurality of cleats positioned on the forefoot region of the outsole and a second plurality of cleats positioned on the heel region of the outsole, wherein each of the first plurality of cleats and the second plurality of cleats are radially arranged about the second convex surface of the outsole.

In still yet another embodiment of Aspect D, the left shoe and the right shoe are left and right mirror images of one another.

According to Aspect E, there is provided a cleated shoe comprising: an upper, a Strobel board or midsole assembled to the upper, and an outsole assembled or bonded to the assembled upper and Strobel board or midsole, and having a plurality of cleats which are secured to or incorporated in the outsole, wherein the cleats have a shape of a truncated half cone having a substantially flat perpendicular side wall, and a slanted curved wall, wherein the insole has a forefoot region, having a first forefoot region configured to underlie heads of the second, third, fourth, and fifth metatarsal bones of a foot of a wearer, and a second forefoot region having a first concave depression extending downward from a top of the insole configured to underlie a head of the first metatarsal bone of the foot of the wearer and configured to permit the head of the first metatarsal bone of the wearer to lower or plantarflex and to evert while under load, wherein the outsole is devoid of cleats in an area underlying the first concave depression in the insole.

In one embodiment of Aspect E, the outsole has a first concave depression configured to underlie the first metatarsal head of the wearer and which is configured to extend as a first convex dome below a bottom surface of the outsole, and wherein a first plurality of said cleats are radially arranged on a first radius around a center point of the first convex dome.

In another embodiment of Aspect E, the cleats are arranged with their substantially flat perpendicular side walls arranged on said first radius around a center point of the first convex dome.

In a further embodiment of Aspect E, the outsole has a second concave depression which is configured to underlie a heel of the wearer and is configured to extend as a convex dome below a bottom surface of the outsole, and wherein a second plurality of said cleats are radially arranged adjacent said second convex surface of the outsole.

In yet another embodiment of Aspect E, at least two of said second plurality of said cleats are arranged forward of said second convex surface on a second radius around a center point of the first convex dome with their substantially flat perpendicular side walls arranged on said second radius.

In still yet another embodiment of Aspect E, at least one of said second plurality of cleats is arranged to the rear of said second convex surface with its substantially flat perpendicular side wall arranged on a third radius around a center point of the first convex dome.

In a further embodiment of Aspect E, the cleated shoe further comprises a third plurality of said cleats arranged around a fourth radius around a center point of said first convex dome, with at least two of said third plurality having their substantially flat perpendicular side walls facing a lateral side of said outsole, and at least two of said third plurality having their substantially flat perpendicular side walls facing the center point of said first convex dome.

In still yet another embodiment of Aspect E, the outsole has an area configured to underlie the metatarsal heads of the wearer, which is devoid of cleats.

In a still further embodiment of Aspect E, there is provided a pair of left and right foot cleated shoes as above described, wherein a left shoe and a right shoe are mirror images of one another.

In another and preferred embodiment of Aspect E, the cleated shoes are football boots, soccer boots, or rugby shoes.

BRIEF DESCRIPTION OF THE DRAWINGS

Other features and advantages of the present disclosure will be seen from the following detailed description taken in conjunction with the accompanying drawings, wherein like numerals depict like parts, and wherein.

DETAILED DESCRIPTION OF THE DISCLOSURE

As used herein the terms "cleat", "spike", and "stud" are used interchangeably. For convenience the term "cleat" shall be used except as noted.

Also, as used herein the terms "Strobel board" and "midsole" are used interchangeably. Also, as used herein the terms "shoe" or "boot" are used interchangeably.

As used herein the term "essentially rigid" as used in describing the forefoot and the heel region and the term "relatively flexible" as used in describing the bridge region, are relative terms to one another.

As used herein the terms "toe, "toeward" and "forward" may be used interchangeably. Also the terms "heel", "heelward" and "rearward" may be used interchangeably.

For simplicity, in the following detailed description and drawings sometimes only half a pair of shoes is illustrated and discussed, it being understood that the other shoe is a mirror image, except in the case of golf shoes, or shoes for shot put, discus, javelin or the like, where the left and right shoes may be different to facilitate unidirectional or asymmetric rotational movement by the wearer.

Figure 1:
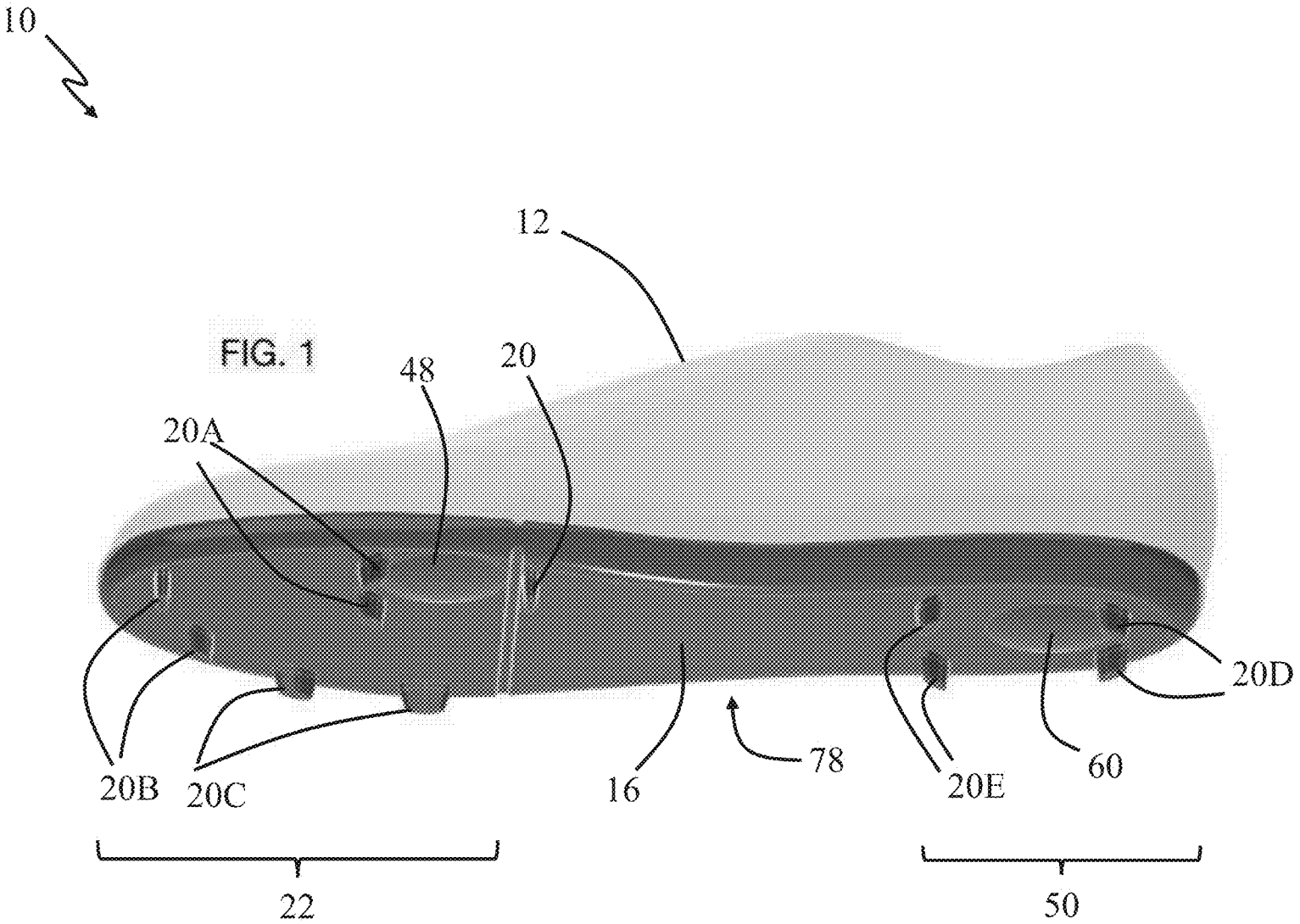
FIG. 1 is a perspective bottom view of a cleated shoe made in accordance with the present disclosure.
Figure 2A:
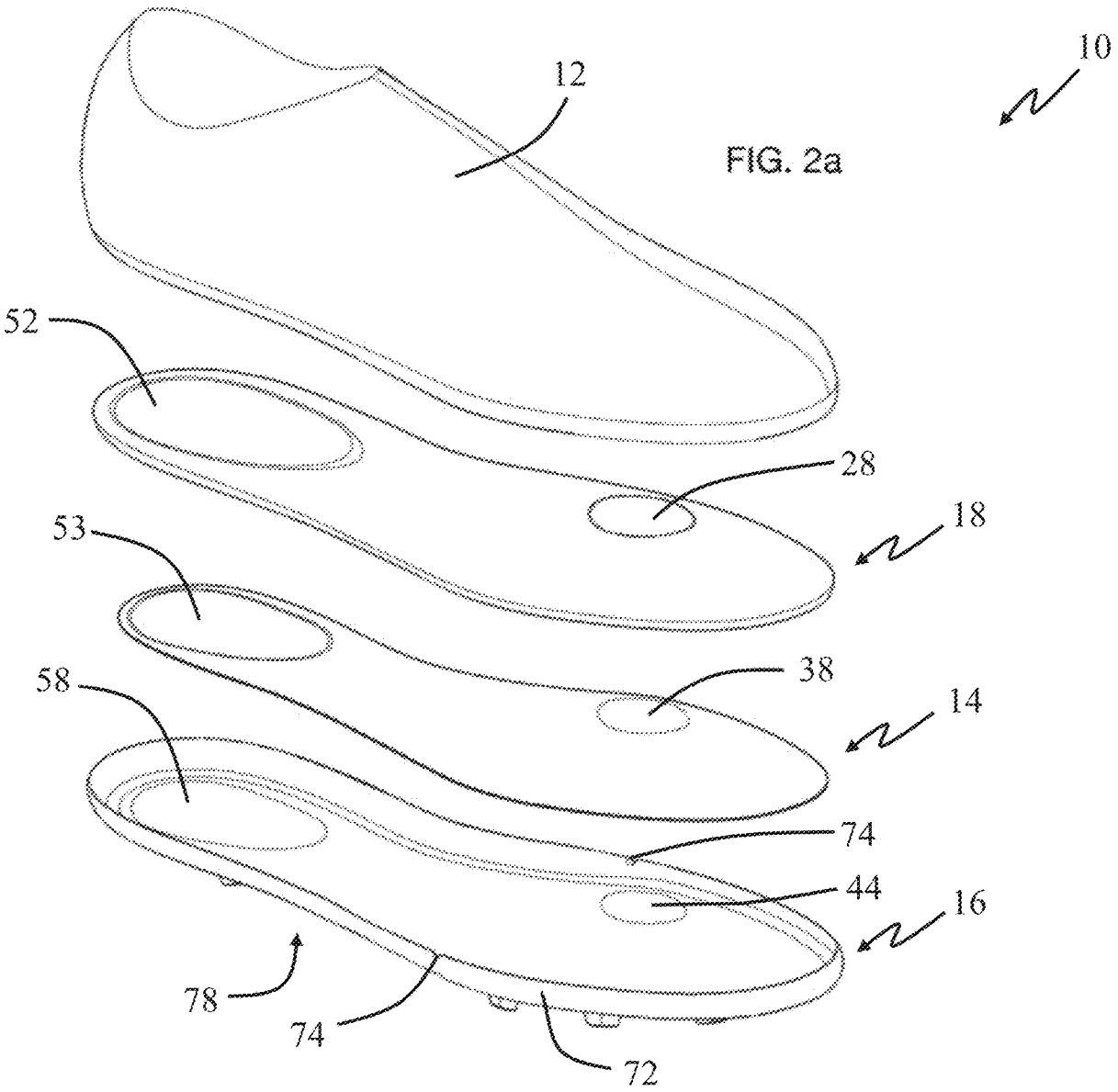
FIG. 2*a* is an exploded view of the cleated shoe of FIG. 1 looking down, in accordance with the present disclosure.
Figure 2B:
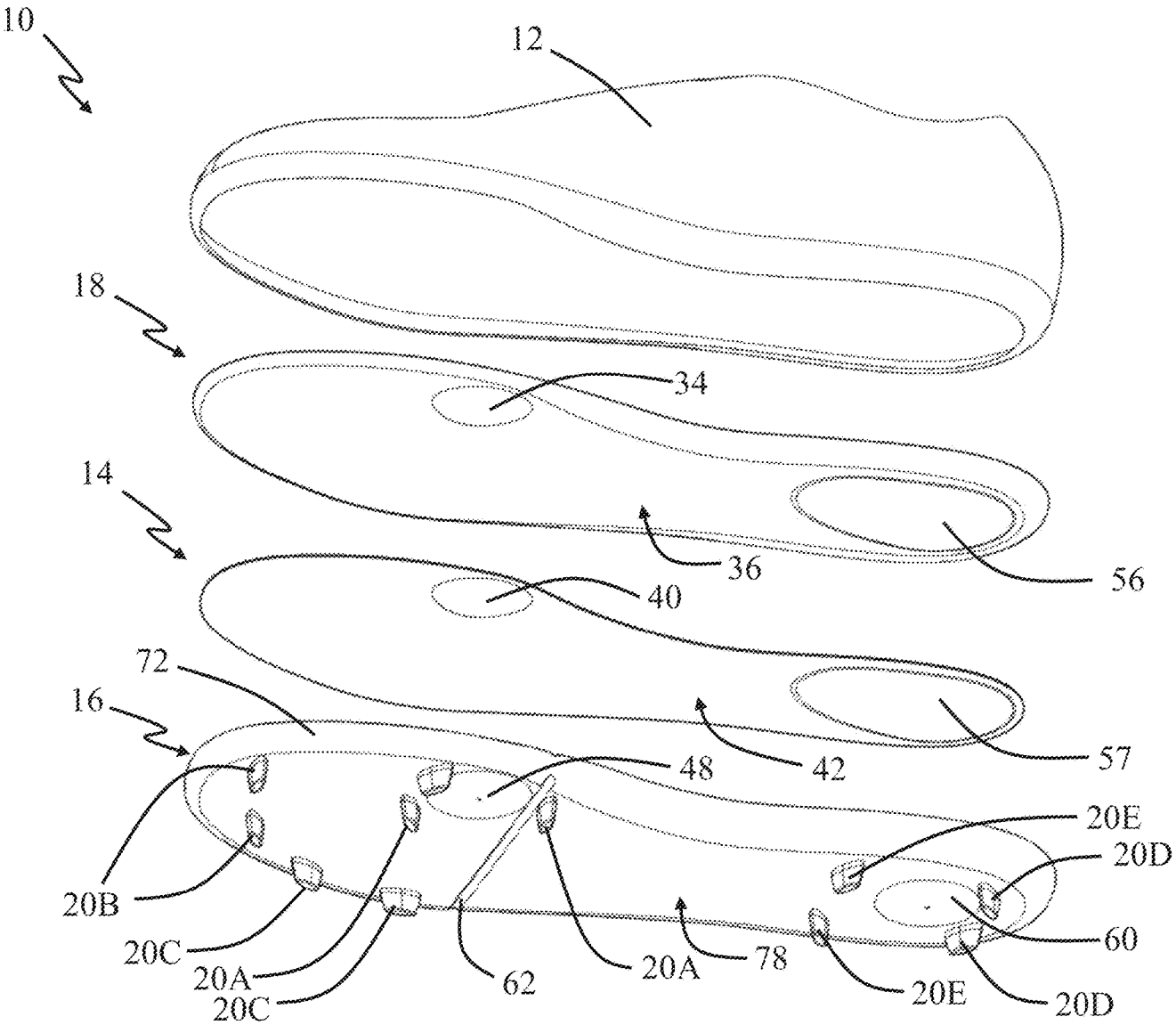
FIG. 2*b* is an exploded view of the cleated shoe of FIG. 1 looking up, in accordance with the present disclosure.
Figure 2C:
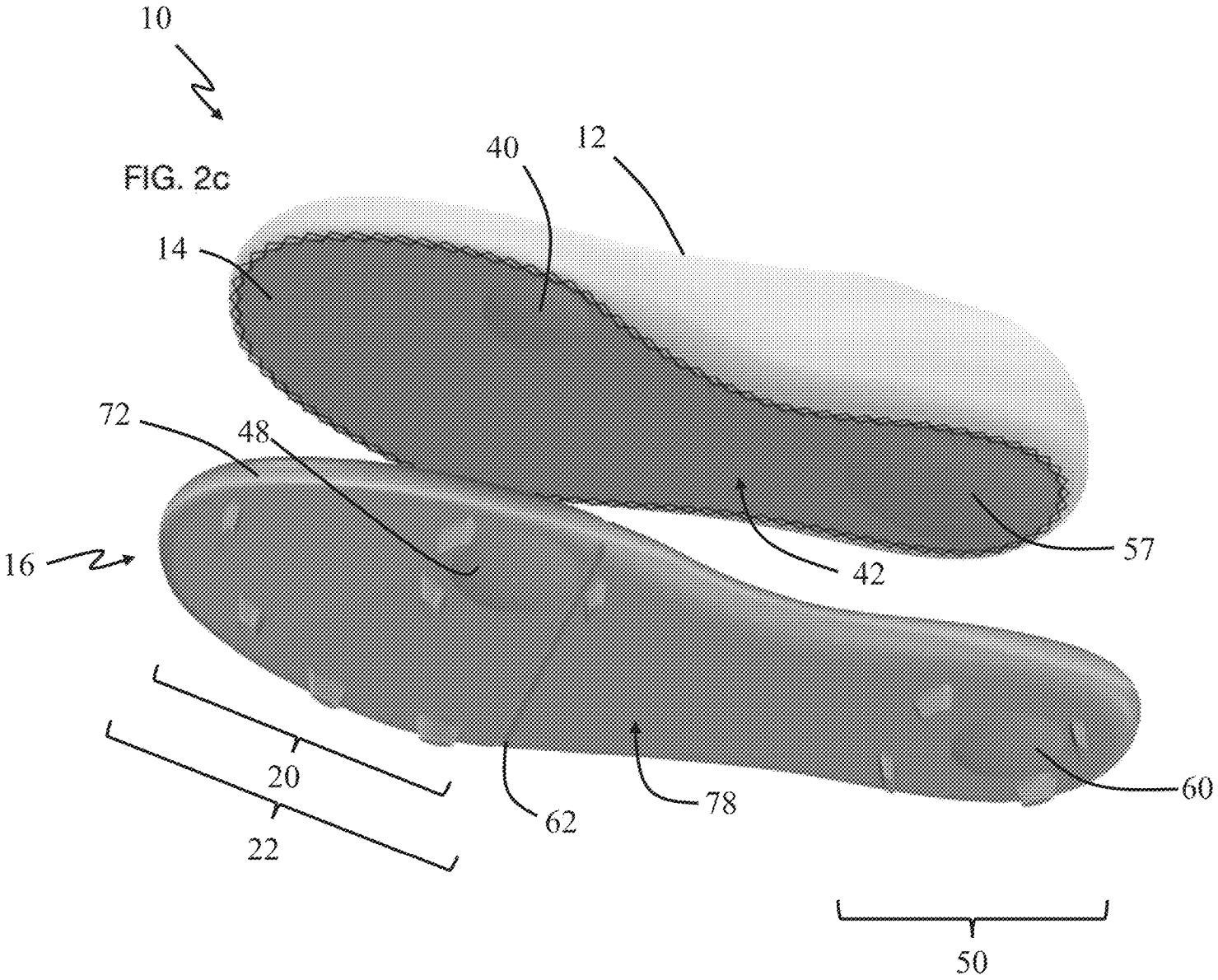
FIG. 2*c* is a partially exploded view of the cleated shoe of FIG. 1 looking up, in accordance with the present disclosure.
Figure 2D:
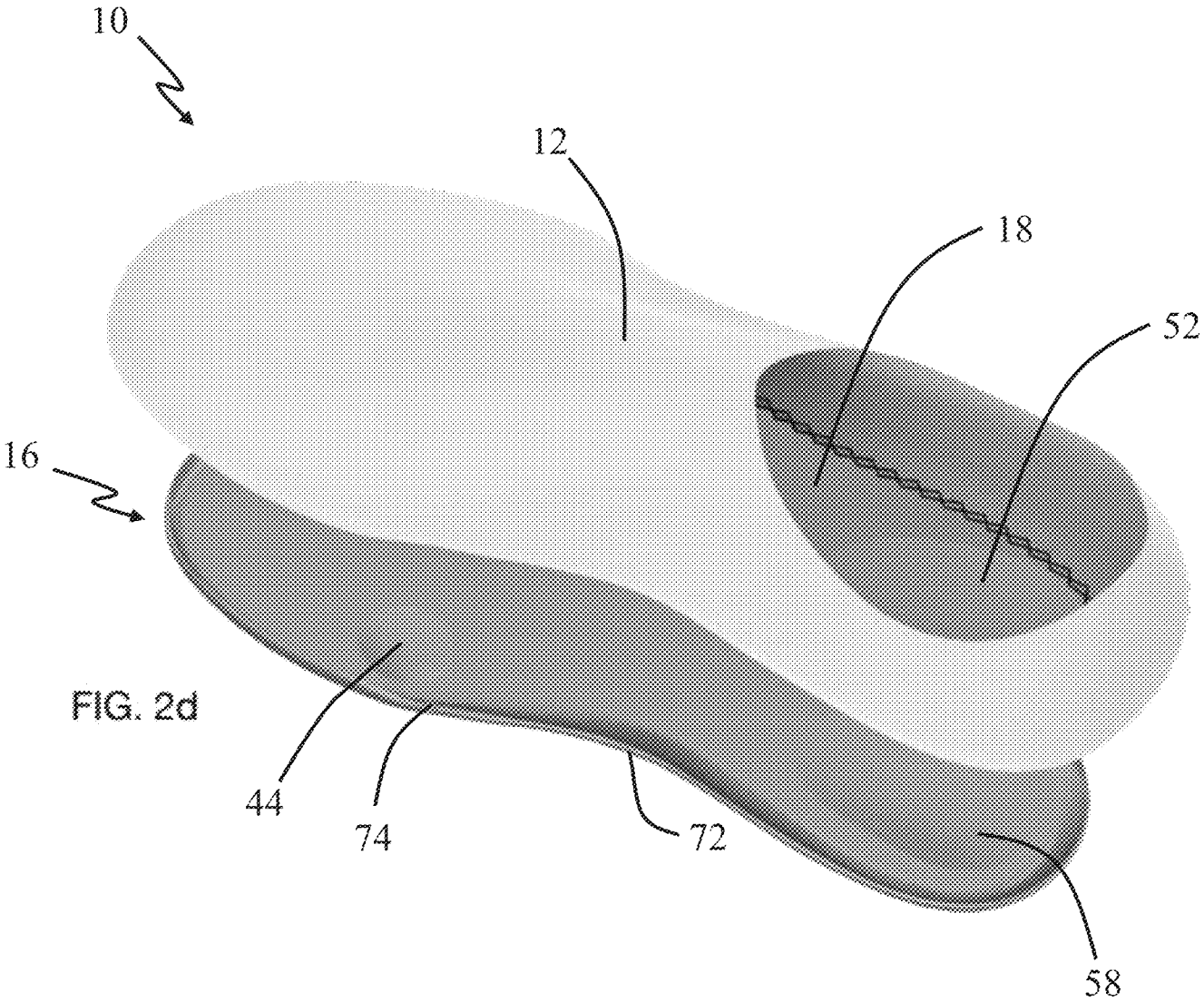
FIG. 2*d* is a partially exploded view of the cleated shoe of FIG. 1 looking down, in accordance with the present disclosure.
Figure 2E:
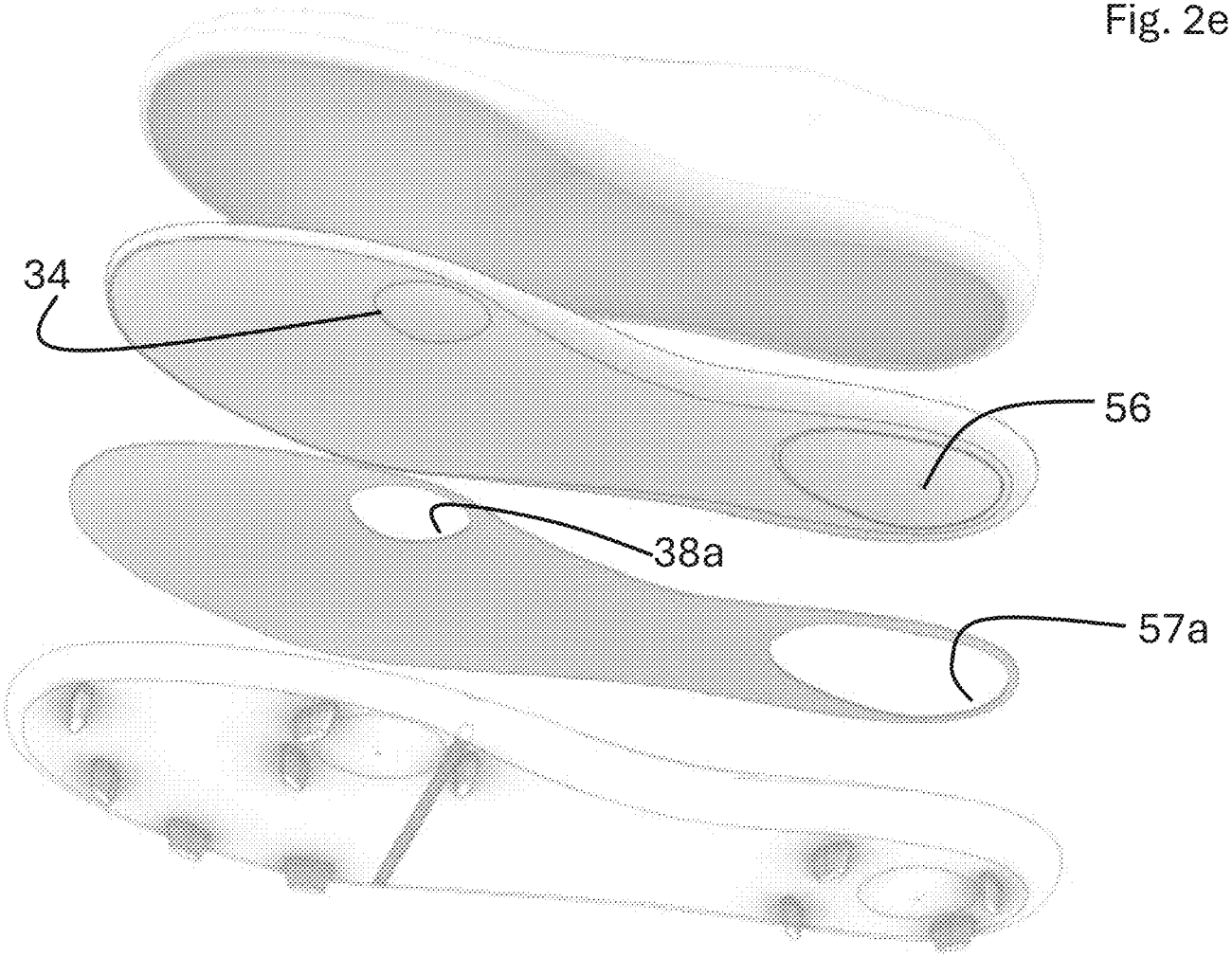
FIGS. 2*e*-2*m* are views similar to FIGS. 2*a* and 2*b* of alternative embodiments of a cleated shoe in accordance with the present disclosure.
Figure 2F:
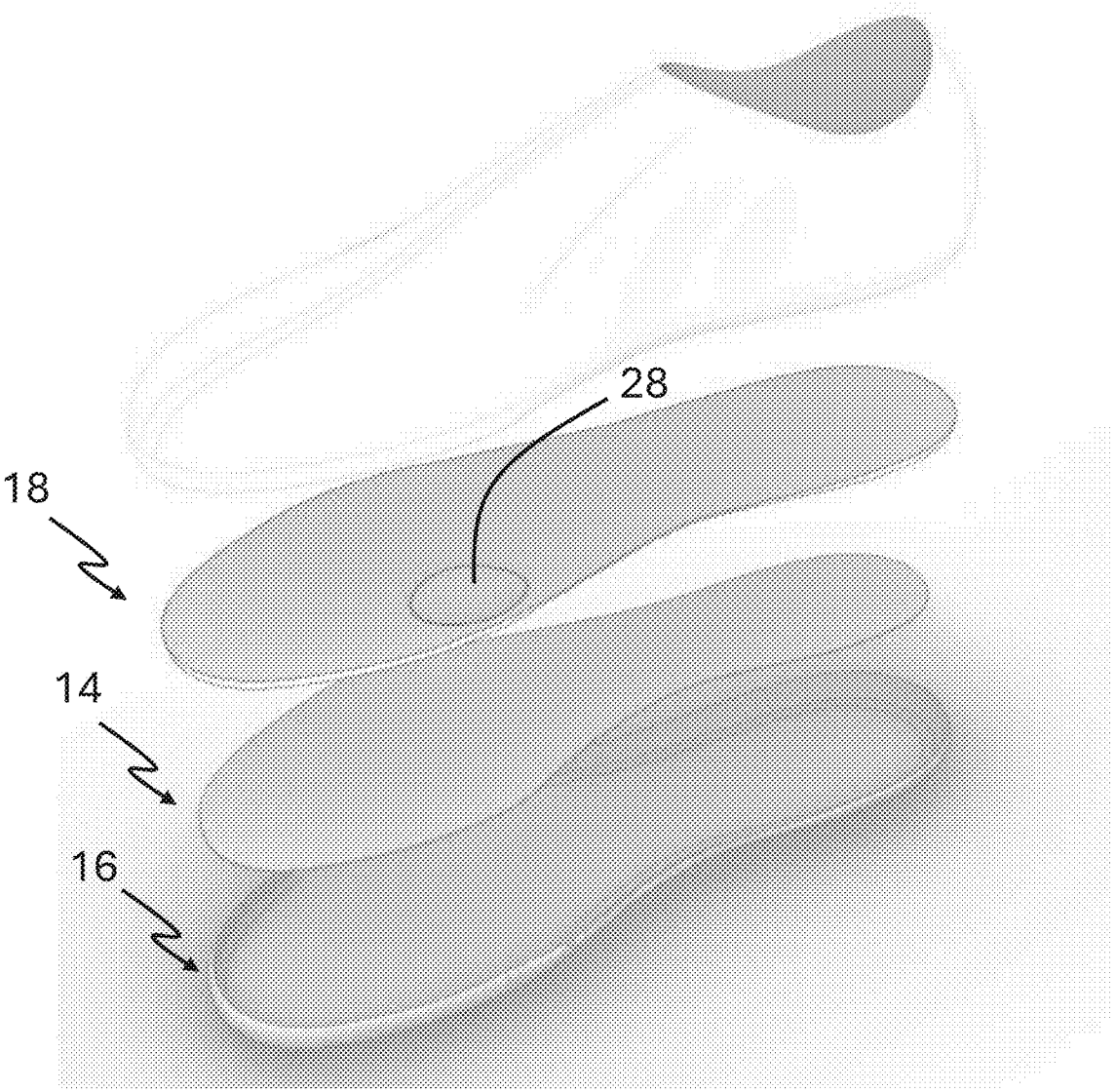
Figure 2G:
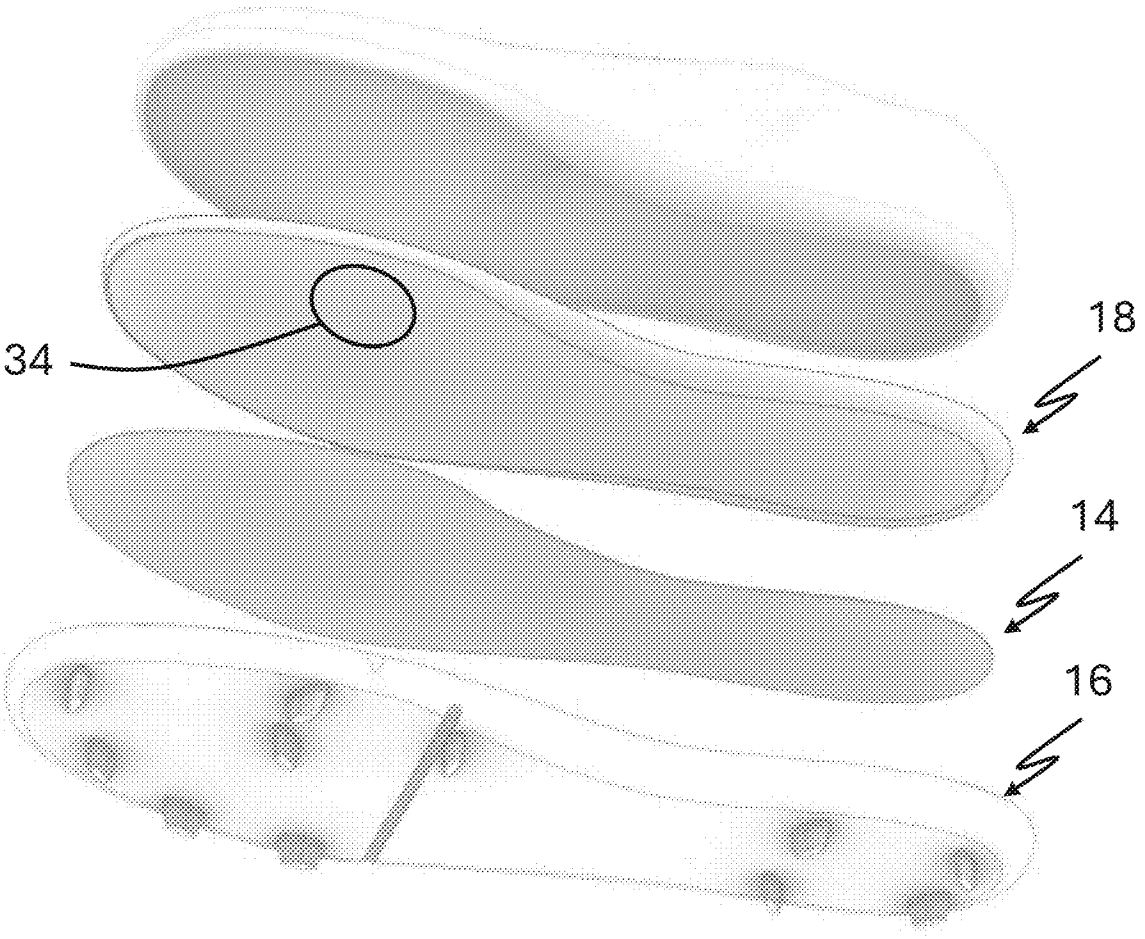
Figure 2H:
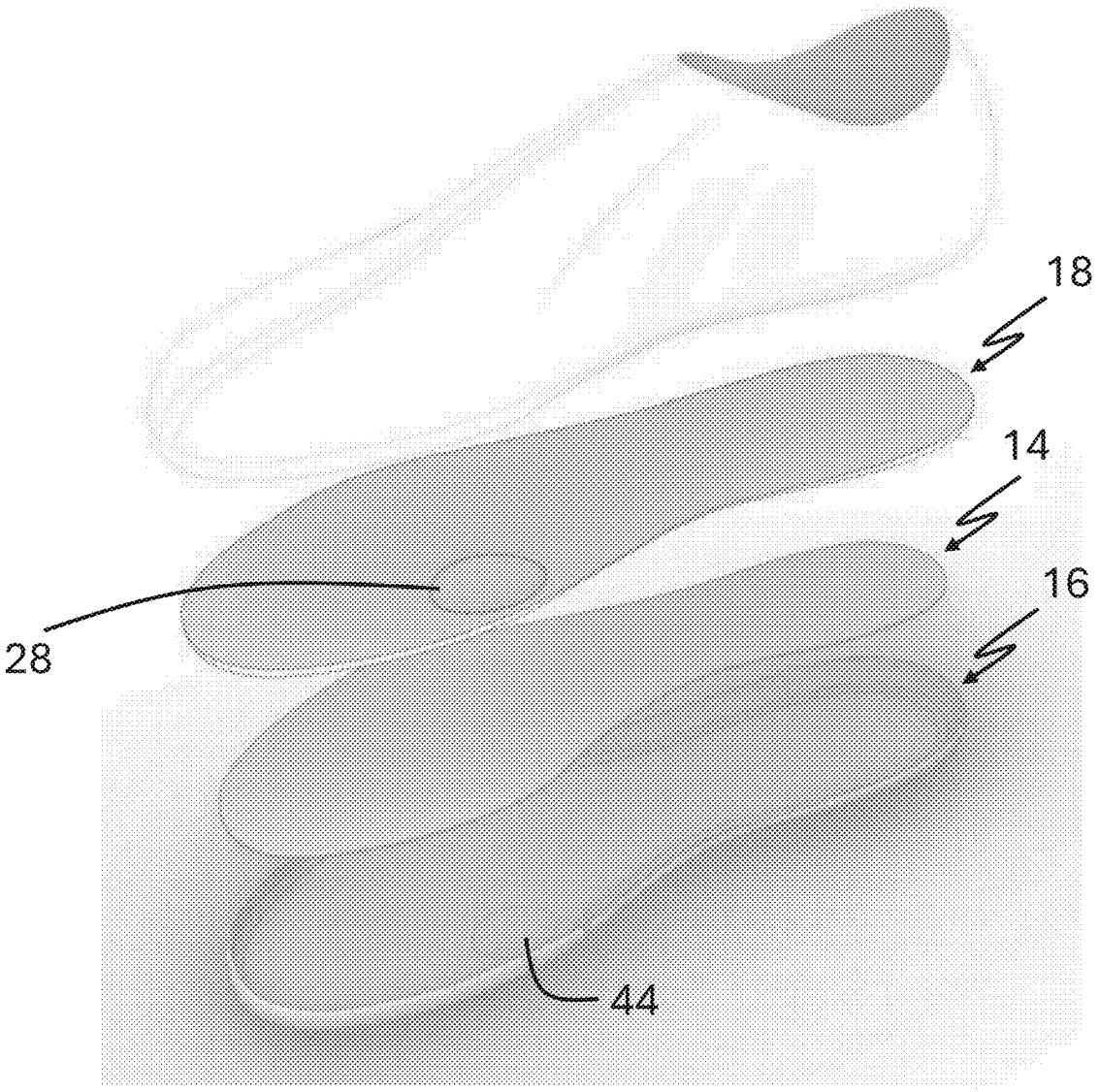
Figure 2I:
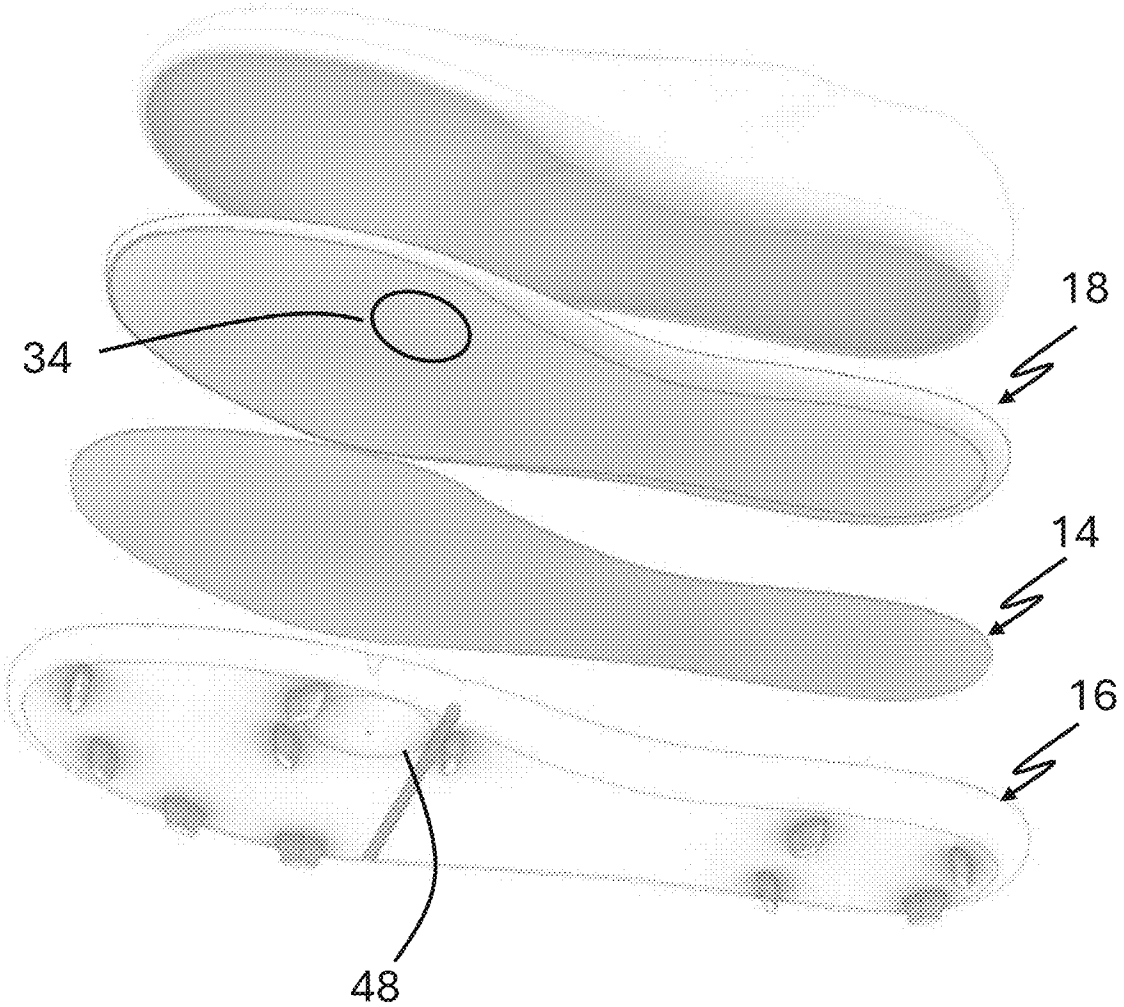

Referring to FIGS. 1-2*d*, there is illustrated a cleated shoe 10 which includes an upper 12 which is bonded or stitched to a Strobel board or midsole 14 which in turn is sandwiched between an outsole 16 comprising a rigid heel region 50 and rigid forefoot region 22 as will be described in detail below, and an insole 18 which overlays Strobel board 14 or midsole.

The cleated shoe 10 includes a depressed area 28 or inverse dome 34 in the forward or forefoot region 22 of the insole 18, which overlies an area 38 of reduced support in the first region of the Strobel board or midsole 14, i.e., foot supporting surface of the forefoot region 22. Insole 18 depressed area 28 and Strobel board or midsole 14 area 38 of reduced support are located to underlie substantially only the first metatarsal head 30 of the wearer, and includes a hollow or depression or inverted dome relative to the remainder of the forefoot region 22, of asymmetric shape with the lowest point of the hollow or depression preferably skewed to the medial side of the center of the spiked or cleated footwear 10, as taught in prior U.S. Pat. No. 8,166,674, the contents of which are incorporated herein by reference. More particularly, the depressed area 28 in the forward or forefoot region 22 of the insole should be of a size sufficient to accommodate, at least in part, the first metatarsal head of the wearer, and permit the first metatarsal head of the wearer to lower or plantarflex and to rotate into eversion as will be discussed below. In a typical embodiment, depressed area 28 is substantially circular in plan, preferably having a diameter of about 2.54 cm to about 3.81 cm. Depressed area 28 also may be oval, egg-shaped or elongated in plan, and may be formed as a through hole, or may take the form of a depression, preferably having a nominal depth in the range of 2-3 mm measured from the top edge of the side walls bounding the depressed area 28 to the lowest point of the depression. Despite this relatively small amount, this has a profound effect of isolating the first metatarsal head of the wearer from the second, third, fourth, and fifth metatarsal heads, and permitting the first metatarsal head of the wearer to lower or plantarflex and to rotate into eversion as the wearer moves from midstance to propulsive phase. The area 38 of reduced support in the Strobel board or midsole also may comprise a hollow or through hole 38*a* (FIG. 2*e*) sized and shaped to accommodate inverse dome 34, which optionally may be filled at least in part with a material having a lower durometer as compared to the Strobel board or midsole. Preferably, hollow 38*a* is unfilled, forming an air gap between the insole 18 and outsole 16, i.e., similar to a drum.

Figure 3A:
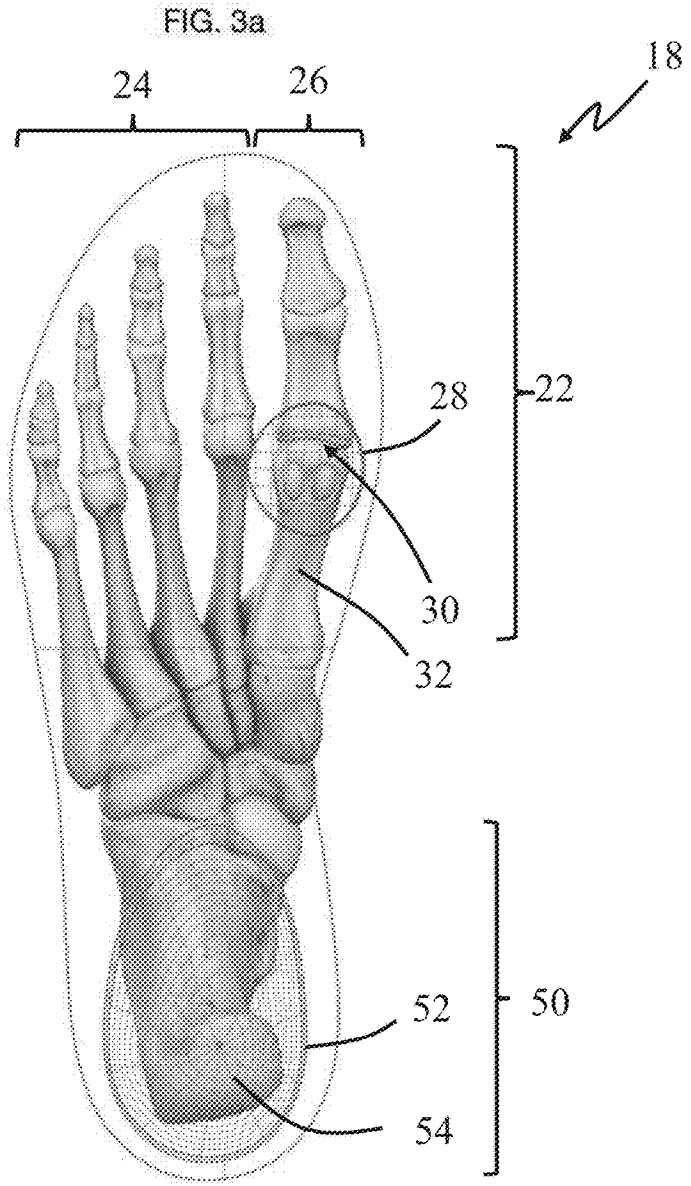
FIG. 3*a* is a bottom plan view showing the bones of a human foot superimposed on the foot support surface of FIG. 3 of the cleated shoe, in accordance with the present disclosure.
Figure 3:
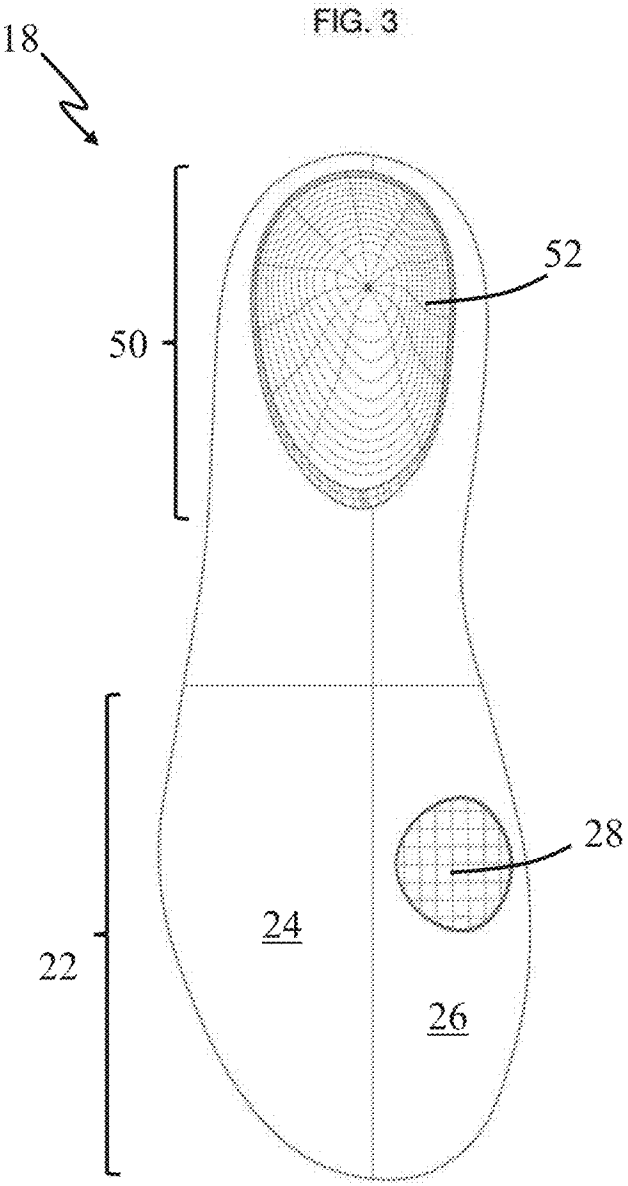
FIG. 3 is a top plan view showing the foot support surface of the cleated shoe, in accordance with the present disclosure.

More particularly, referred to FIGS. 3 and 3*a*, the insole 18 has a forefoot region 22, which has a first forefoot region 24 and a second forefoot region 26. The first forefoot region 24 is configured to underlie heads of the second, third, fourth, and fifth metatarsal bones of a foot of a wearer. Second forefoot region 26 has a concave depression 28 which extends downward from a top side of the insole. The concave depression 28 in the second forefoot region 26 is configured to underlie substantially only a head 30 of the first metatarsal bone 32 of the foot of the wearer. Positioning of the concave depression 28 under the head 30 of the first metatarsal bone 32 of the wearer, isolates support of the first head from the heads of second, third, fourth and fifth metatarsal bones of the wearer, and permit the head 30 of the first metatarsal bone 32 of the wearer to lower or plantarflex and to evert while under load. The concave depression 28 may be a region of the second forefoot region 26 with reduced support and/or may be a region where the insole 18, has a concave depression 28 which extends as a convex surface 34 below a bottom surface 36 of the insole and into an area 38 of reduced support in the Strobel board or midsole 14. The area 38 or reduced support of Strobel board or midsole 14 preferably comprises a through hole or hollow 38*a* (FIG. 2*e*) in the Strobel board or insole 14, but may also comprise a convex surface 40 below a bottom surface 42 of the Strobel board or midsole 14 and into a corresponding concave depression 44 in outsole 16. The concave depression 44 of the outsole 16 may extend as a convex surface 48 below a bottom surface 78 of the outsole 16.

The concave depression 44 of the outsole 16 may extend below the bottom surface 78 of the outsole 16 at the forefoot region 22 as a rounded inverted dome like structure or convex surface 48. The forefoot region 22 of the outsole 16 may have a plurality of cleats 20 substantially surrounding the dome like structure 48. However, the dome 48 itself is free of cleats, thereby leaving the first metatarsal head of the wearer unloaded. In one embodiment, a first plurality of cleats 20A on the forefoot region may be radially arranged about the convex surface 48 of the outsole 16. Also a second plurality of radially disposed cleats 20B are arranged from in front of the big toe of the wearer and a third plurality of radially disposed cleats 20C are arranged along the outside lateral edge of the shoe.

The heel region 50 of Strobel board or midsole 14 may also include a concave heel depression 53 or heel cup 53 in the form of a lop-sided generally round shaped concave heel depression 53 extending from the foot supporting surface, with its lowest region on its medial side. There is a corresponding lop-sided generally round shaped concave heel depression 52 in the insole 18. These two concave heel depressions 52, 53 serve to reduce pressure on the plantar facia of the wearer's foot as it travels from its attachment on the medial calcaneus to the proximal phalanges, i.e., as taught in our prior U.S. Pat. No. 10,702,008, the contents of which are incorporated herein by reference. Heel cup 53 typically is 1-4 mm deep at its lowest, preferably 2-3.5 mm deep, more preferably 2.5-3 mm deep. The insole concave heel depression 52 extends below the bottom surface 36 of the insole 18 at heel region 50 as a convex heel surface 56 which may be a rounded inverted dome like structure. The convex heel surface 56 of the insole 18 may extend into a corresponding concave heel depression 53 of Strobel board or midsole 14. The heel depression 53 may extend below the bottom surface 42 of the Strobel board or midsole 14 at heel region 50 as a convex heel surface 57 which may be a round inverted done like structure. The convex heel surface 57 of the Strobel board or midsole 14 may extend into a corresponding concave heel depression 58 of the outsole 16. Alternatively, the heel section of the Strobel board or midsole 14 may comprise a hollow or through hole 57*a* (FIG. 2*e*) insole 18 depressed area 28, sized and shaped to accommodate convex heel surface 56 of insole 18. The concave heel depression 58 of the outsole 16 may then, in turn, extend from the bottom surface 78 of the outsole 16 to form a second convex surface 60 on the outsole 16, where the second convex surface 60 is positioned at the heel region 50 of outsole 16 to substantially correspond with the alignment of a wearer's calcaneus bone 54.

The heel region 50 of the outsole 16 may also have a plurality of cleats 20D, 20E radially arranged about the second convex surface 60 of the outsole 16. The outsole 16 may also have a flex channel 62 positioned on the bottom surface 78 posterior to the convex surface 48 of the forefoot region 22. A flex notch 74 may also be positioned on an outsole sidewall 72, where the flex notch 74 is positioned on the outsole sidewall 72 substantially in line with the flex channel 62. The flex channel 62 and flex notch 74 may aid in permitting the metatarsals of the wearer to plantarflex and evert while under load, and in conjunction with the concave depression 28, 38, 44 may permit the head 30 of the first metatarsal bone 32 of the wearer to plantarflex and evert while under load.

Figure 4:
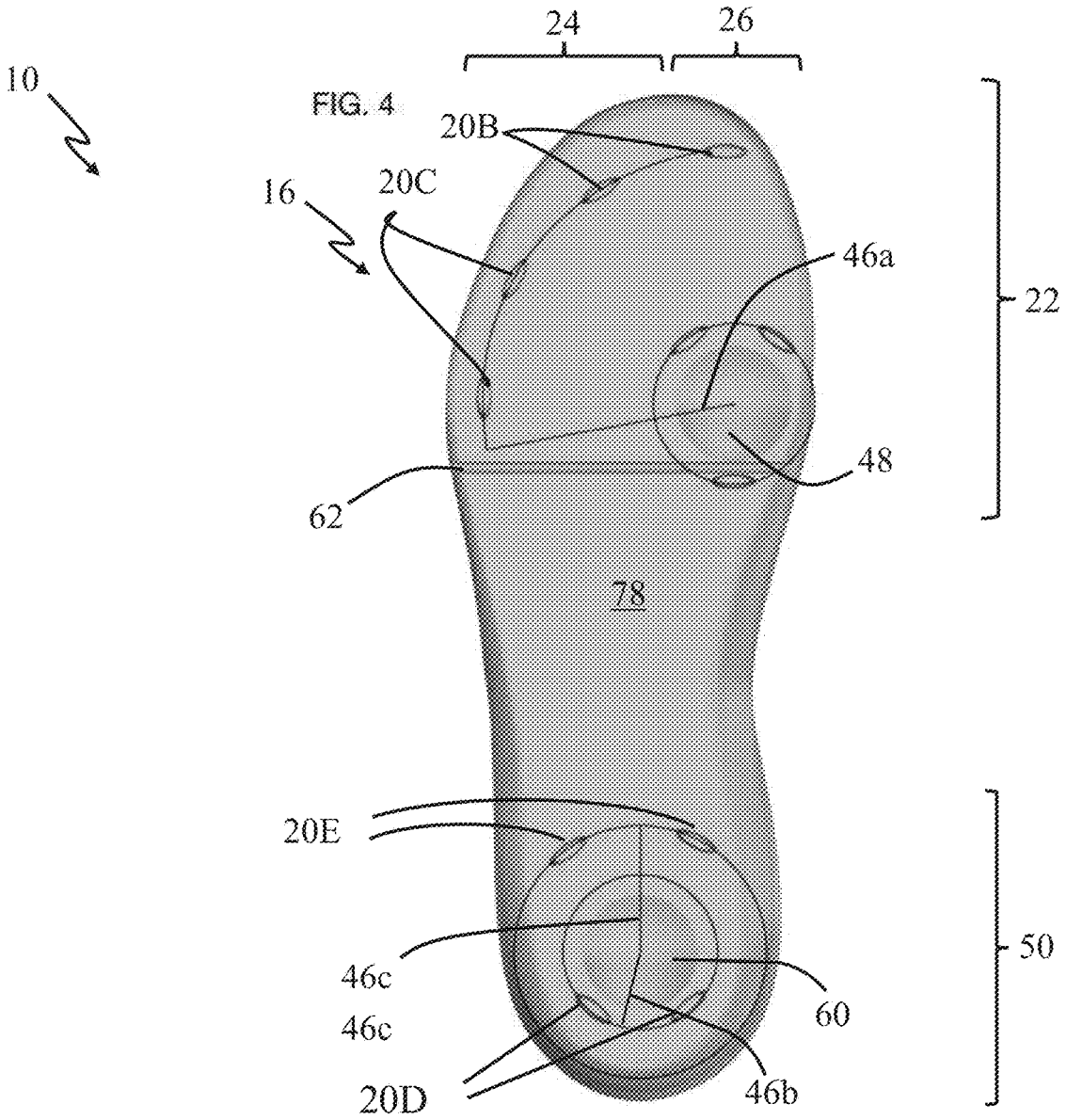
FIG. 4 is a bottom plan view of a cleated outsole for a cleated shoe, in accordance with the present disclosure.

FIG. 4 is a bottom plan view of a cleated outsole 16 for a cleated shoe 10, in accordance with the present disclosure. In particular, illustrated is a first plurality of cleats 20B positioned at the forefoot region 22 of the outsole 16 and a second plurality of cleats 20D, 20E positioned at the heel region 50 of the outsole. At least a portion of the first plurality of cleats 20B may be positioned essentially on a radius 46*a* extending from a center point of the convex surface 48 of the forefoot region 22. A second portion of the first plurality of cleats 20C may also be radially disposed as perimeter cleats which may be added along the outside medial edge of the outsole 16 for additional stability. The perimeter cleats 20C may also be arranged essentially on a radius 46*a* which extends from the center point of the convex surface 48 of the forefoot region 22.

In this same example, the third plurality of cleats 20D, 20E may be radially arranged about the second convex surface 60 of the outsole 16 at the heel region 50. The third plurality of cleats 20D may be arranged essentially on a radius 46*b* extending from a center point of the second convex surface 60. The radius 46*b* at the heel region may vary in length, thus allowing for various arrangements of the third plurality of cleats 20D. In one example, two of the second plurality of cleats 20D may be arranged on a first radius 46*b* having a length. A fourth of the second plurality of cleats 20E may then be arranged on a second radius 46*c* having a larger length, thereby placing the third and fourth of the second plurality of cleats 20E at a further distance away from the second convex surface 60. The flex channel 62 may additionally be provided to facilitate plantarflexion and eversion of the metatarsals of the wearer while under load.

Figure 5:
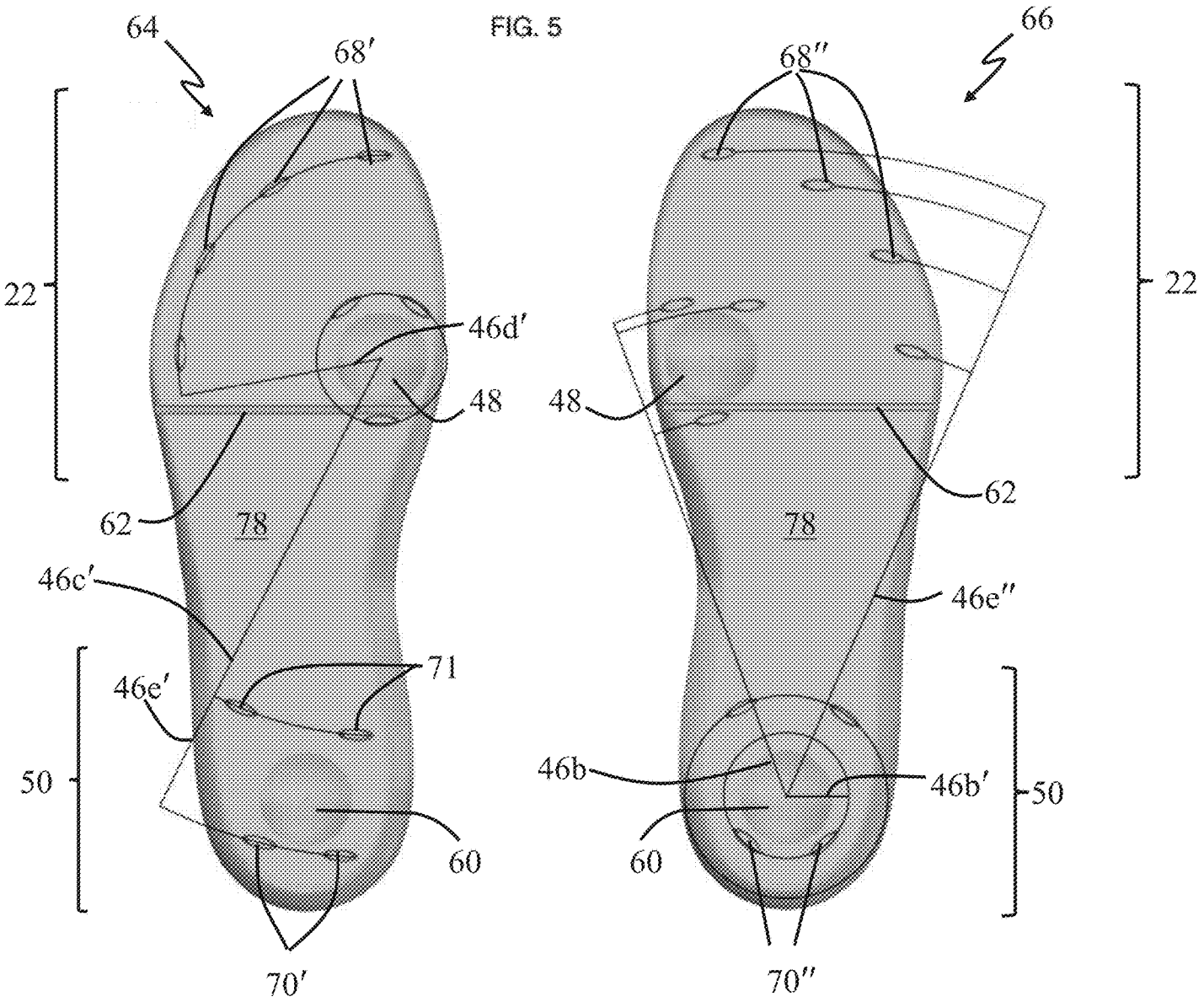
FIG. 5 is a bottom plan view of a cleated outsole for showing the differences between the left shoe and the right shoe, in accordance with the present disclosure.

FIG. 5 is a bottom plan view of a cleated outsole 16 for showing the differences between the right shoe 64 and the left shoe 66, optimized for use in golf or shot put, in accordance with the present disclosure. In this example the outsole 16 of the right shoe 64 may be different from the outsole of the left shoe 66. In particular, one of the right shoe 64 or left shoe 66, in this example, the right shoe 64 may have a first plurality of cleats 68' positioned at the forefoot region 22 of outsole 16 and radially arranged about the convex surface 48. A second plurality of cleats 70' may be positioned at the heel region 50 and may be radially arranged on a radius 46*c*' about the center point of convex surface 48. The first plurality of cleats on the right shoe 64 may be arranged essentially on a radius 46*d*' extending from the center point of the convex surface 48 and the third plurality of cleats 71 on the right shoe 64 may be arranged essentially on a radius 46*c*' extending from the center point of convex surface 48.

The other of the right shoe 64 or left shoe 66 may have a differing arrangement for the first and second plurality of cleats 68, 70. In this example, the first and second plurality of cleats 68", 70" of the left shoe 66 may be arranged radially about the second convex surface 60. The first and second plurality of cleats 68", 70" of the left shoe 66 may be arranged essentially on a radius 46*e*", 46*b*', respectively extending from a center point of the second convex surface 60. In such an example, the right and left shoes 64, 66 primarily may still largely be mirror images of one another, where the differing aspect may lie in the outsole 16. The bottom surface 78 of the outsole 16 of each right and left shoe 64, 66 may have a flex channel 62, or in some examples, one of the right or left shoe 64, 66 may have a flex channel 62 where the other does not, and in some examples, neither right or left shoe 64, 66 will have a flex channel 62.

Figure 6:
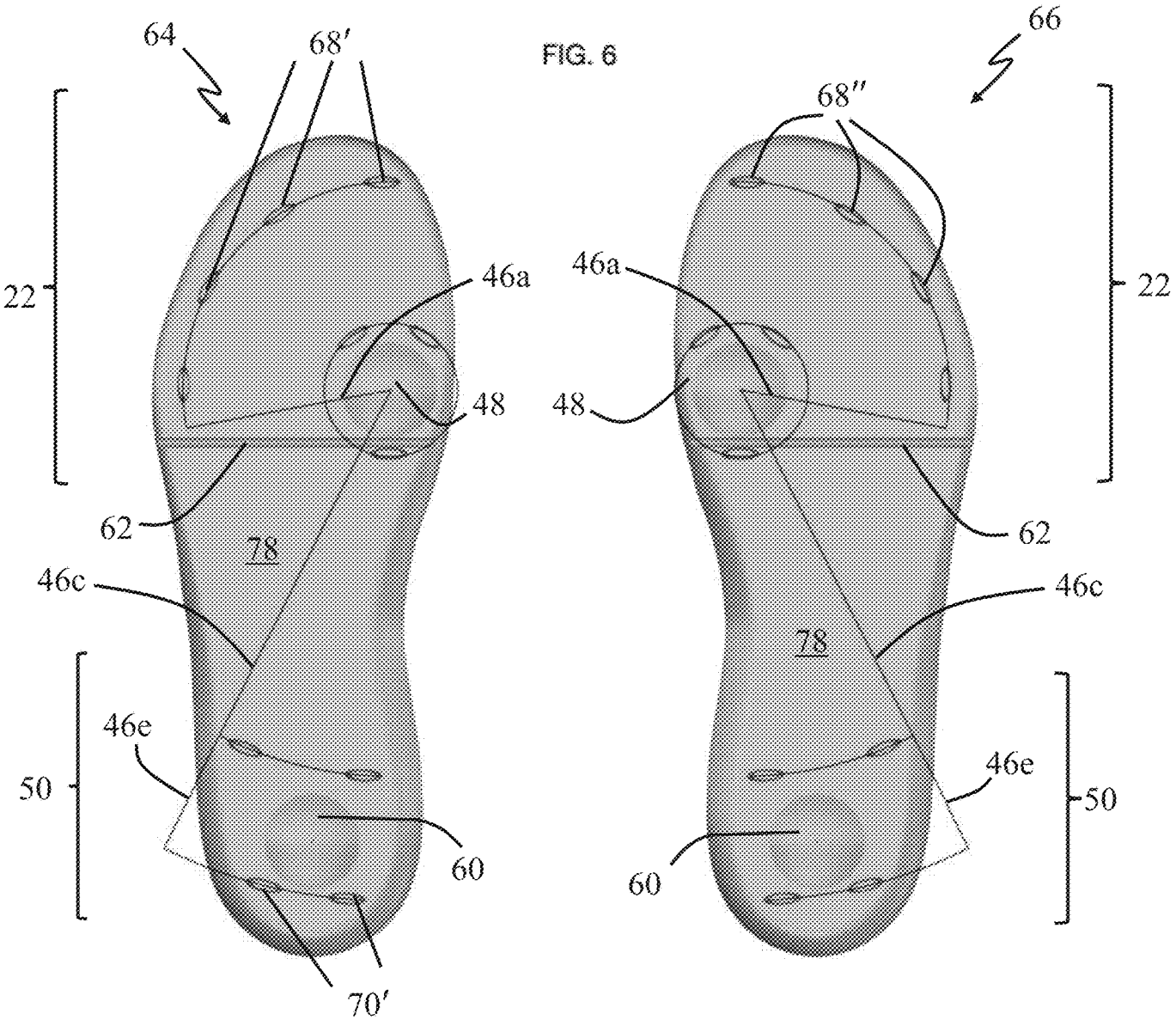
FIG. 6 is a bottom plan view of a cleated outsole for a pair of shoes optimized for rotation about the ball of either foot, in accordance with the present disclosure.

FIG. 6 is a bottom plan view of cleated outsoles 16 for a pair of right and left shoes 64, 66 optimized for running straight, and stops and turns, in accordance with the present disclosure. In this example, the right and left shoes 64, 66 are mirror images of one another and the outsoles 16 of each shoe is also a mirror image of one another. Each of the first and second plurality of cleats 68, 70 are arranged essentially on a radius 46*a*, 46*e* extending from a center point of the convex surface 48 on the forefoot region 22 of the outsole 16. FIG. 6 contains several similar elements and structures as previously recited relative to FIGS. 1-5 and are not restated herein for brevity in disclosure.

Figure 7:
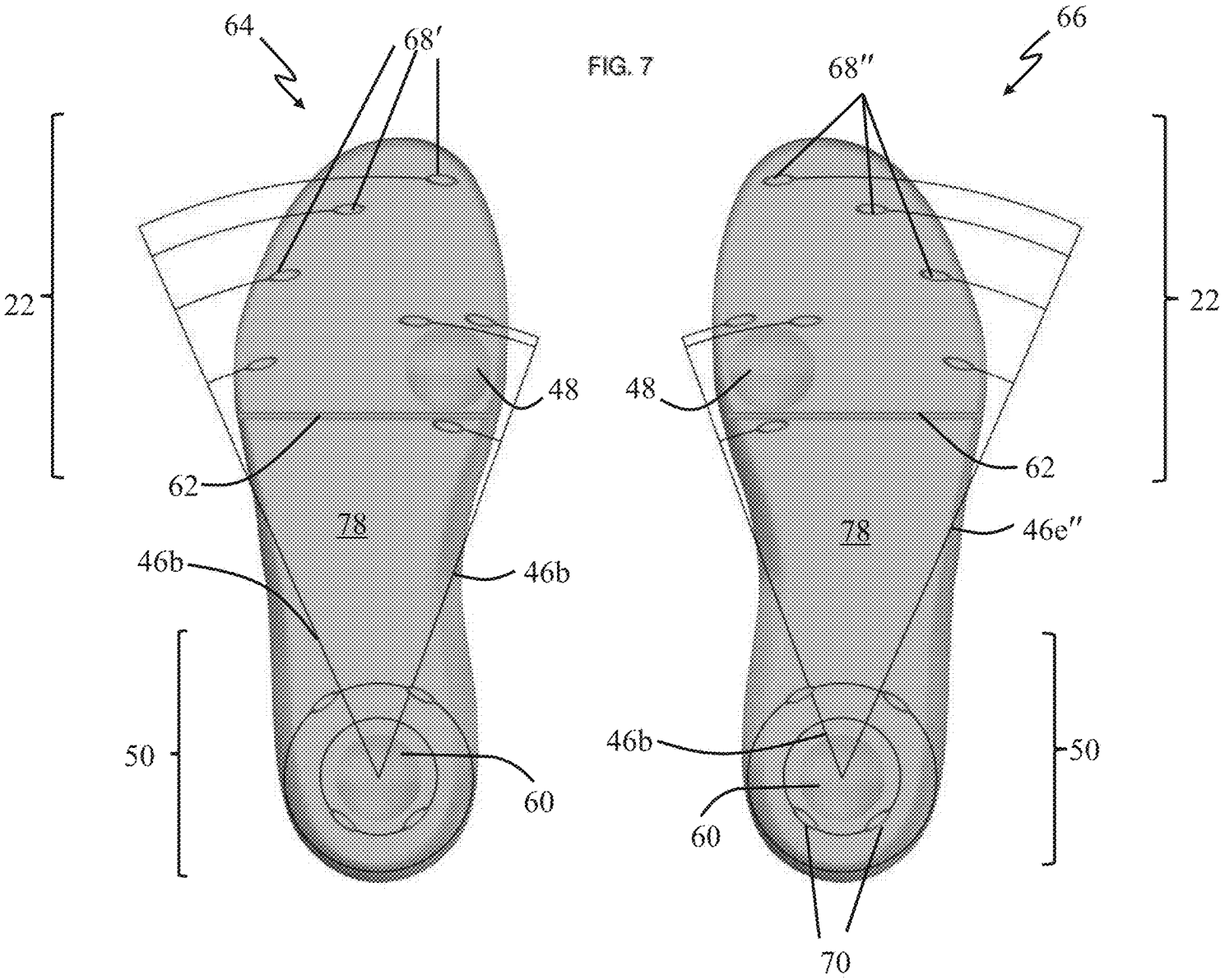
FIG. 7 is a bottom plan view of a cleated outsole for a pair of shoes optimized for rotation about the heel of either foot, in accordance with the present disclosure.

FIG. 7 is a bottom plan view of cleated outsoles 16 for a pair of right and left shoes, 64, 66 optimized for rotation about the heel of either foot, in accordance with the present disclosure. In this example, the right and left shoes 64, 66 are mirror images of one another and the outsoles 16 of each shoe is also a mirror image of one another. Each of the first and second plurality of cleats 68, 70 are arranged essentially on various radii as illustrated extending from a center point of the second convex surface 60 on the heel region 50 of the outsole 16. FIG. 7 contains several similar elements and structures as previously recited relative to FIGS. 1-5 and are not restated herein for brevity in disclosure.

With reference to FIGS. 1-7, the outsole may have cleats 20 that are oval in cross-section arranged with the short axis in line with the center of rotation so that the first cleat 20 "cuts" a path for the subsequent cleats 20, to reduce resistance to rotary motion about the portion of the first plurality of cleats 68 positioned proximal to the convex surface 48 of outsole 16 at the forefoot 22 and/or the second plurality of cleats 70 positioned proximal to the second convex surface 60 of the outsole 16 at the heel region 50.

Moreover, at least a portion of the first plurality of cleats 68 and the second plurality of cleats 70 are located to surround the convex surface 48 and the second convex surface 60, respectively, and is thus approximately positioned under the first metatarsal head, and the tuberosities of the calcaneus, respectively, thereby providing centers of rotation around both the ball of the foot and the calcaneus.

Various changes may be made in the foregoing disclosure without departing from the spirit and scope thereof. For example, while the disclosure has been made particularly with respect to soccer shoes, the disclosure advantageously also may beneficially be used with other cleated footwear, including, for example those used in baseball, football, and track shoes advantageously may particularly benefit from our technology. Also, sports footwear such as golf shoes, and track shoes for shot put, discus, javelin, and the like in which the wearer imposes unidirectional or asymmetric rotational movement advantageously may benefit from our technology by fashioning the left and right shoes to accommodate such movements. For example, as in the case of golf, the wearer's feet pronate and supinate in opposite directions during a swing. Thus, as illustrated in FIG. 5 the left and right shoes are fashioned to accommodate asymmetric rotational movement and would be different for left and right handed players. As illustrated, the right shoe focuses rotation around the ball of the foot, while the left shoe focuses rotation around the calcaneus or heel bone of the foot. Alternatively, the right shoe could be provided with cleats spikes that focus rotation around the heels of the feet, while the left shoe could be provided with cleats that focus rotation around the ball of the feet. The outsole and insole also may be 3D printed to custom fit the shoes to the wearer.

Figures 8, 8A:
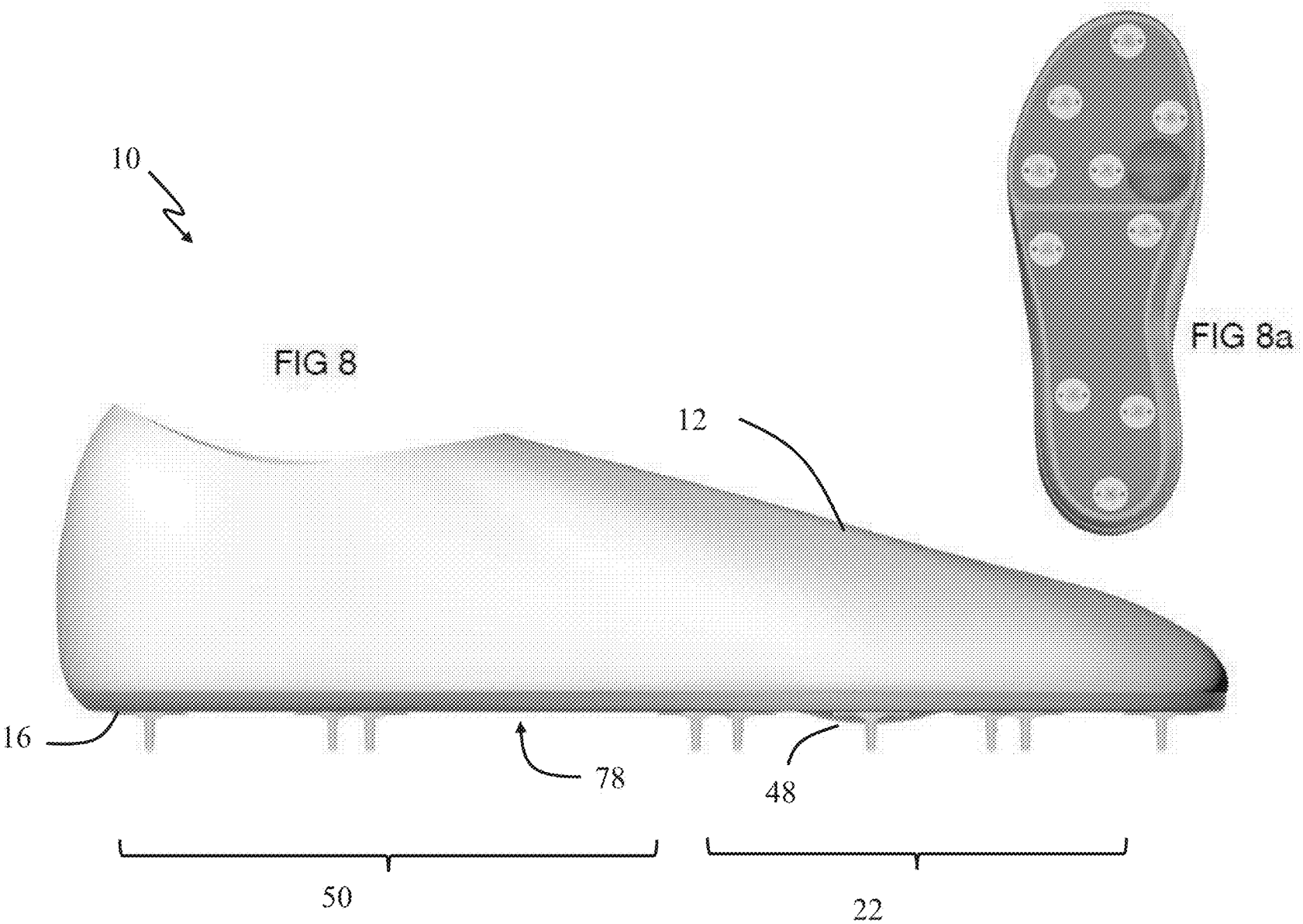
FIG. 8 is a side elevational view and FIG. 8*a* is a bottom plan view of a cleated shoe, in accordance with the present disclosure.
Figure 9:
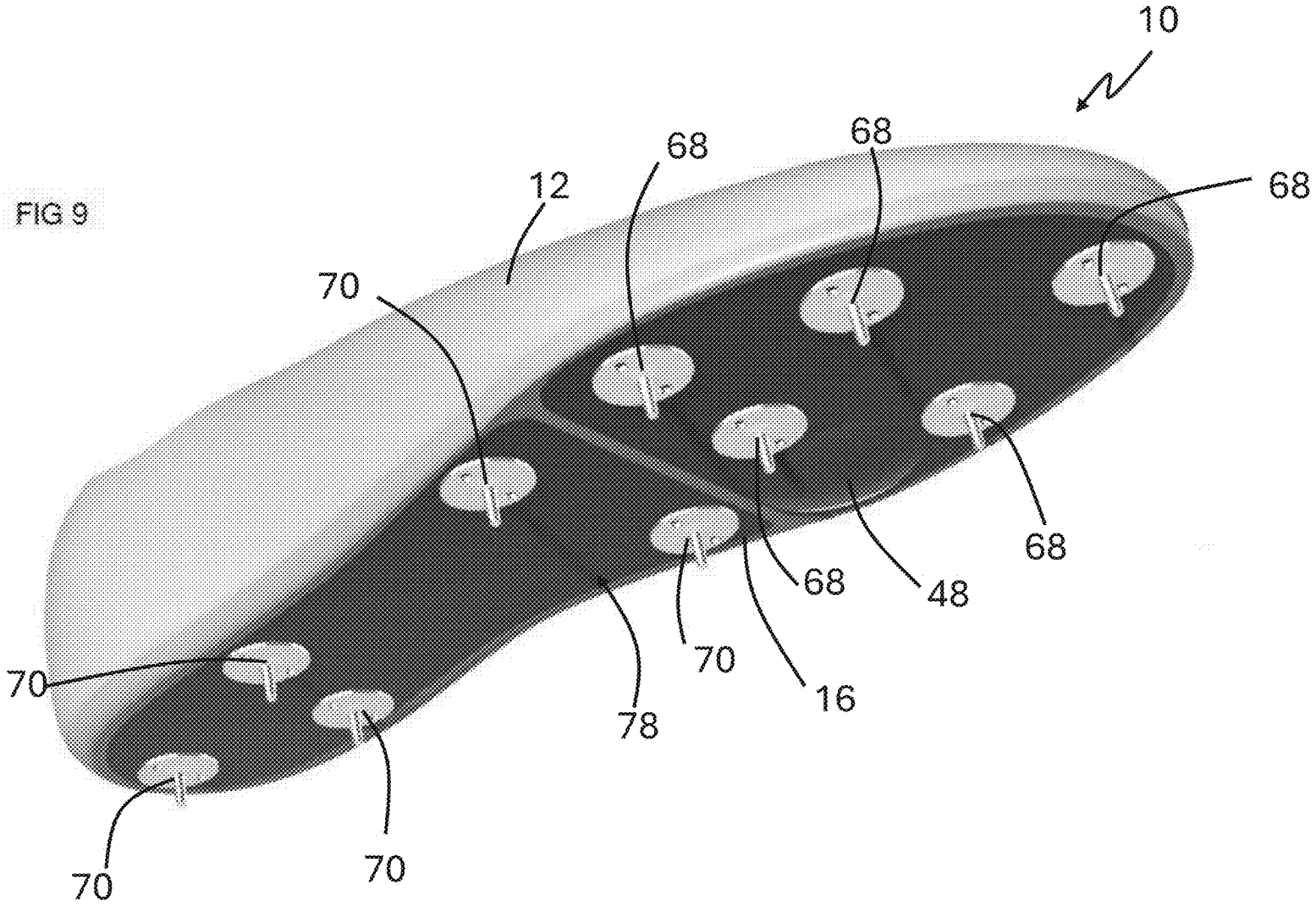
FIG. 9 is a perspective bottom view of the cleated shoe of FIG. 8, in accordance with the present disclosure.

Referring to FIGS. 8-9, there is illustrated a cleated shoe 10 particularly used in cricket. In this embodiment shoe 10 has a first plurality of removable spikes or pins 68 positionable on the forefoot region 22 of the outsole 16 and a second plurality of removable spikes or pins 70 positionable on the heel region 50 of the outsole 16. In particular, the forefoot region 22 may include a convex surface 48 which corresponds to a hollow depression, concave surface, or inverted dome located inside of the shoe 10 and on at least one of the insole, the Strobel board or midsole, or the outsole 16. The hollow depression, concave surface, or inverted dome is located to underlie substantially only the first metatarsal head of the wearer, and to include a hollow depression or inverted dome relative to the remainder of the forefoot region, of asymmetric shape with the lowest point of the hollow, depressed, or inverted dome skewed to the medial side of the center, as taught in prior U.S. Pat. No. 8,166,674, the contents of which are incorporated herein by reference.

The convex surface 48 or inverted dome extends below the bottom surface 78 of the outsole 16 as an inverted round dome like structure. Convex surface 48 may include a center spike or pin 20, but preferably is devoid of a center spike or pin 20. The first and second plurality of spikes or pins 68, 70 may be positioned symmetrically on the outsole 16 of the shoe, or may be symmetric in their numbering, i.e., if there are two spikes or pins 20 on the lateral side of the outsole 16, there are two spikes or pins, 20 on the medial side of the outsole 16. Each of the individual spikes or pins of both of the first and second plurality of spikes or pins 68, 70 may be positioned on the forefoot region 22 of outsole 16 and on the heel region 50 of outsole 16. Each of the individual cleats of both the first and second plurality of spikes or pins 68, 70 may be fixed or removably attached to their respective positions on the outsole 16 by threaded fastener, mechanical fastener, glue, epoxy, and the like.

Figure 10:
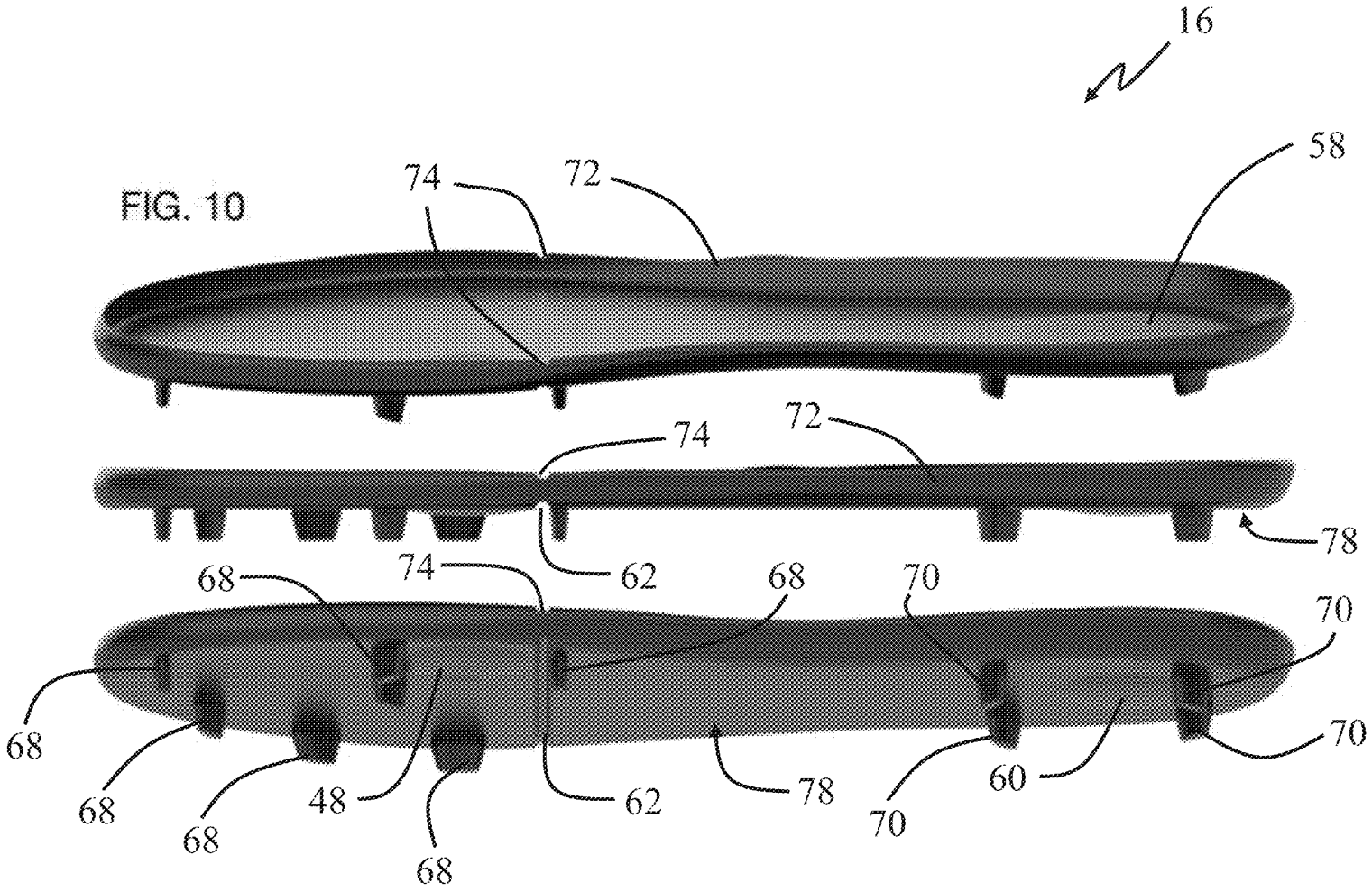
FIG. 10 is a top perspective, side elevational, and bottom perspective view of a cleated outsole, in accordance with the present disclosure.

FIG. 10 is a top perspective, side elevational, and bottom perspective view of a cleated outsole 16, in accordance with the present disclosure A flex channel 62 on the bottom surface 78 of the outsole 16 is provided to aid in flexing of the shoe. A corresponding flex notch 74 may be provided on the outsole sidewall 72, where the positioning of the flex notch 74 substantially corresponds to the positioning of the flex channel 62. The flex notch 74 may be positioned on each of a medial side edge of the outsole sidewall 72, and a corresponding flex notch 74 positioned on a lateral side edge of the outsole sidewall 72. As illustrated in the side elevational view of FIG. 10, the flex notch 74 may be positioned in a vertical arrangement with respect to the flex channel 62. Each of the flex channel 62 and the flex notch 74 may be areas with decreased material to provide a region of the outsole 16 that can more easily bend with respect to the remainder of the outsole 16. FIG. 10 contains several similar elements and structures as previously recited relative to FIGS. 1-5 and are not restated herein for brevity in disclosure.

Figure 11:
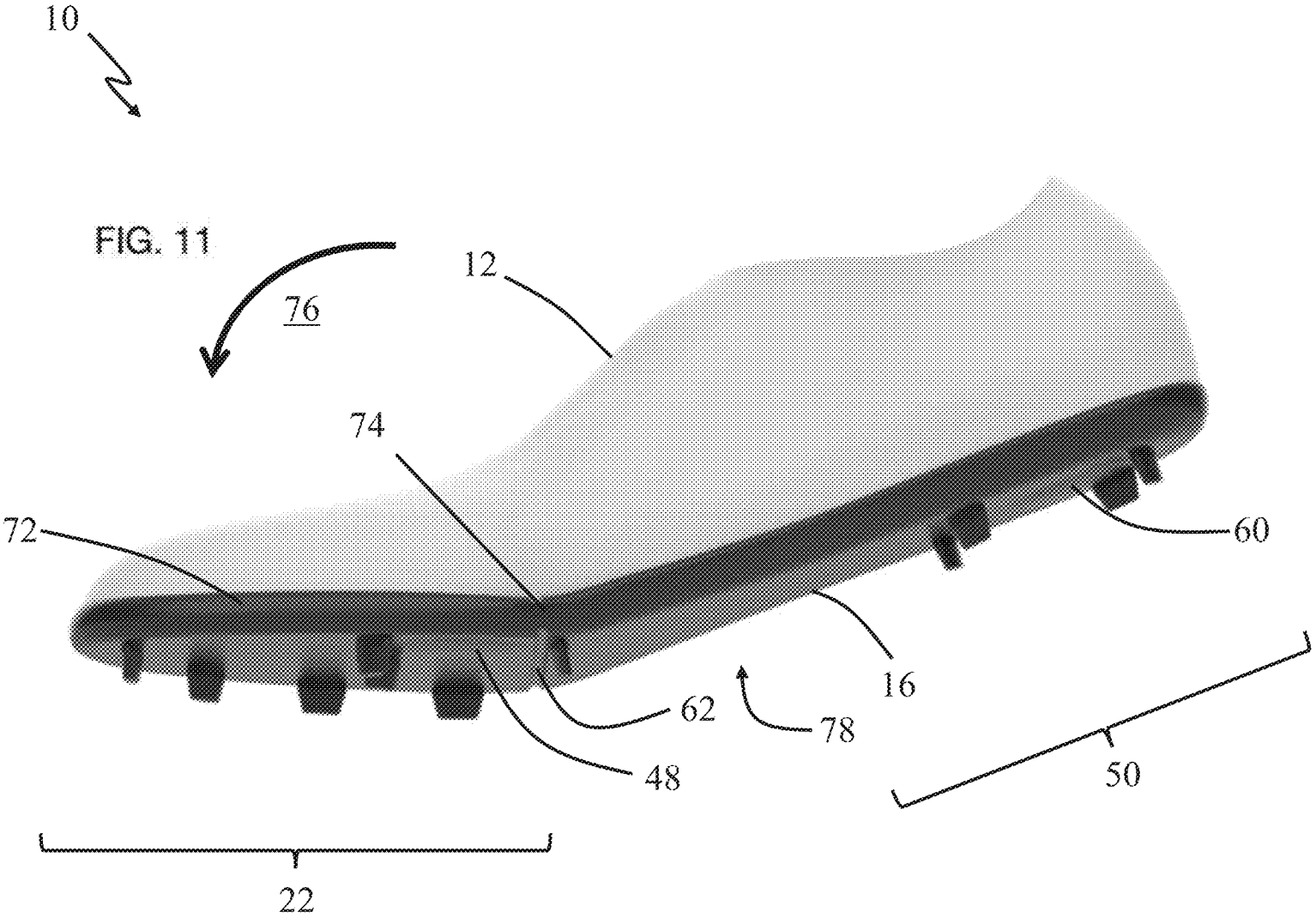
FIG. 11 is a side elevational view of a cleated shoe in flex, in accordance with the present disclosure.

FIG. 11 is a side elevational view of a cleated shoe 10 in flex, in accordance with the present disclosure. As a force 76 or load is applied to the shoe 10, the shoe 10 and outsole 16 may flex, particularly along the flex channel 62 positioned posteriorly to the convex surface 48. In this example, a wearer may be walking or running. As the weight of the wearer shifts to the forefoot region 22 the wearer's foot may plantarflex, causing the heel of the wearer to raise, thereby raising at least a portion of the heel region 50. In doing so, the surface area of the outsole 16 in contact with the ground decreases. The first plurality of cleats 68 ensures contact and stability with the ground surface during this period of decreased surface area contact between the shoe 10 and the ground surface. Additionally, the flex channel 62 and the convex surface 48 corresponding to a concave depression in the insole facilitate weight transfer and plantarflexion by allowing the shoe 10 and the outsole 16 to more easily bend or flex when under a force 76 or load. FIG. 11 contains several similar elements and structures as previously recited relative to FIGS. 1-5 and are not restated herein for brevity in disclosure.

Figure 12:
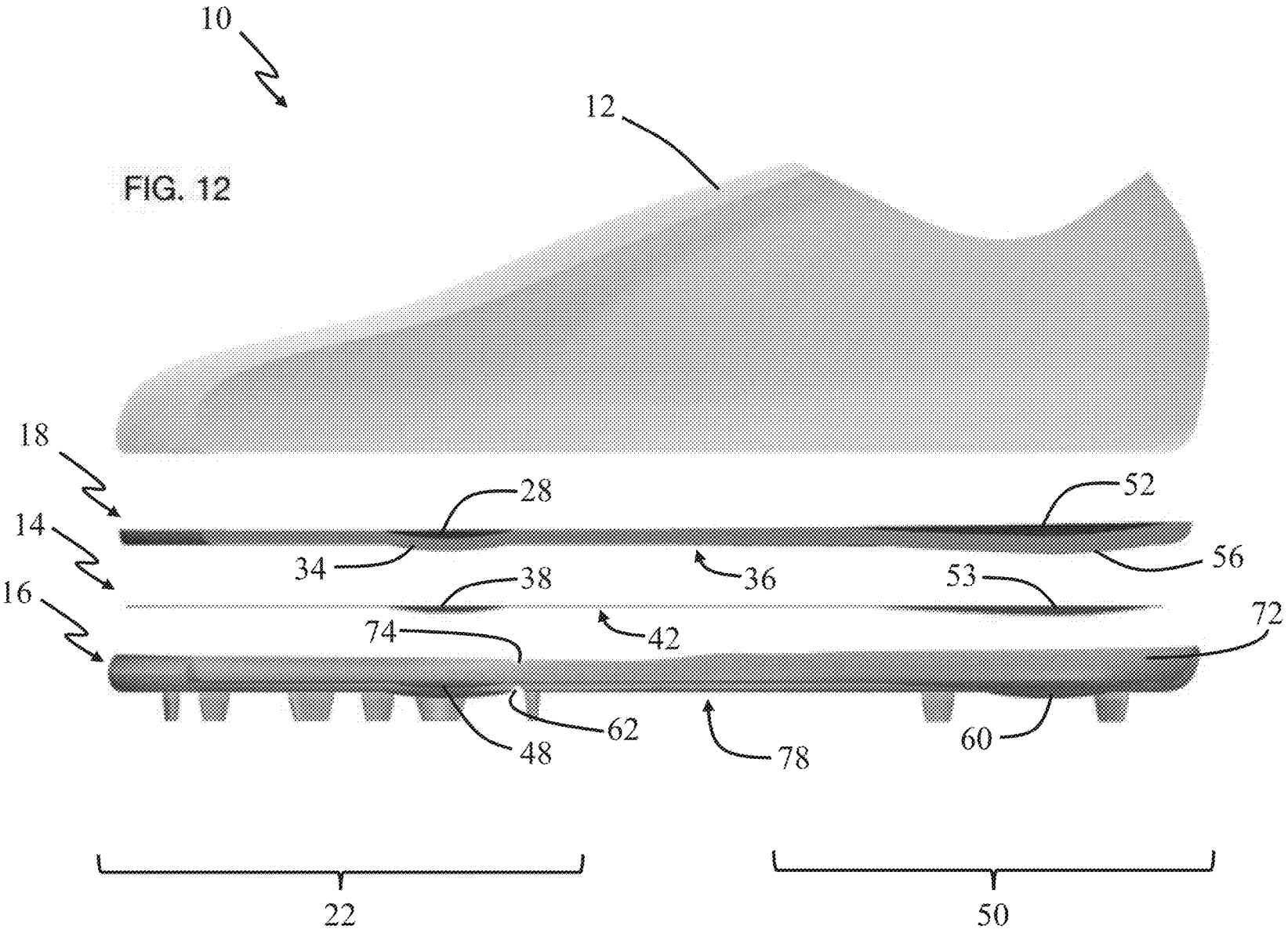
FIG. 12 is an exploded side elevational view of a cleated shoe, that is sliced vertically along the line A-A shown in FIG. 12*a*, in accordance with the present disclosure.
Figure 12A:
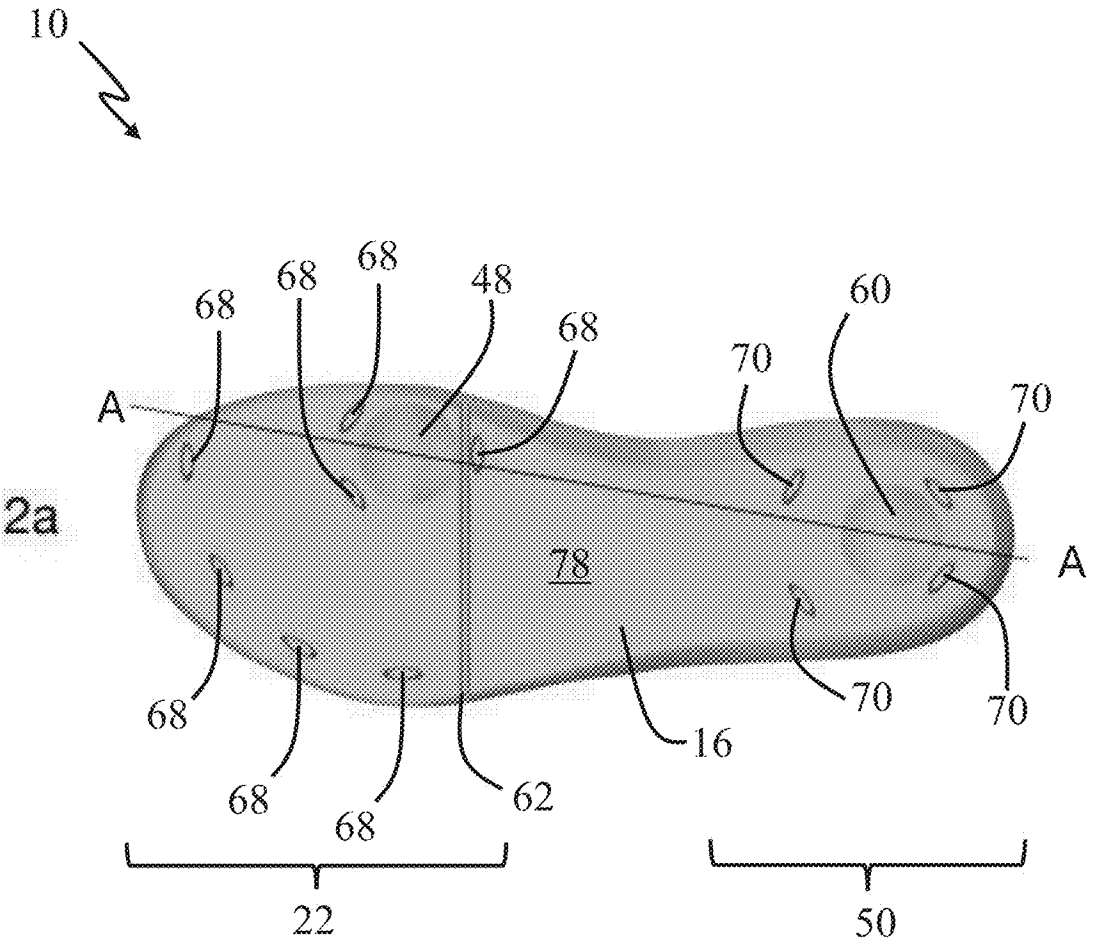
FIG. 12*a* is a bottom plan view of a spiked or cleated shoe, showing the line A-A that FIG. 12 is sliced vertically through, in accordance with the present disclosure.

FIG. 12 is an exploded side elevational view of a cleated shoe 10, in accordance with the present disclosure and FIG. 12*a* is a bottom plan view of cleated shoe 10, in accordance with the present disclosure. In particular, FIGS. 12-12*a* illustrate each of the components of the shoe 10, including the upper 12, insole 18, Strobel board or midsole 14, and outsole 16, along with corresponding structures that enables fitment of each piece. Insole 18 and Strobel board or midsole 14 may be connected or adhered to one another by stitching, glue, epoxy heated bonding, and the like. The insole 18 alone, or in combination with the Strobel board or midsole 14 may be stitched, glued, epoxied, or the like to the upper 12 of the shoe. Preferably the insole 18 is removable, so that it may be replaced when worn out. The outsole 16 may be bonded or adhered to the insole 18, the Strobel board or midsole 14, or at least a portion of the upper 12 by glue, epoxy, and the like. Based on the playing surface (i.e., grass or turf), the plurality cleats or spikes 68, 70 may be made longer for grass or shorter for artificial turf so that the total of them will be flat on any given surface when the shoe is at rest and both the forefoot region 22 and the heel region 50 are in contact with the surface. The outsole sidewall 72 may extend to surround or contact at least a portion of the upper 12. FIGS. 12-12*a* contain several similar elements and structures as previously recited relative to FIGS. 1-5 and are not restated herein for brevity in disclosure.

Figure 13:
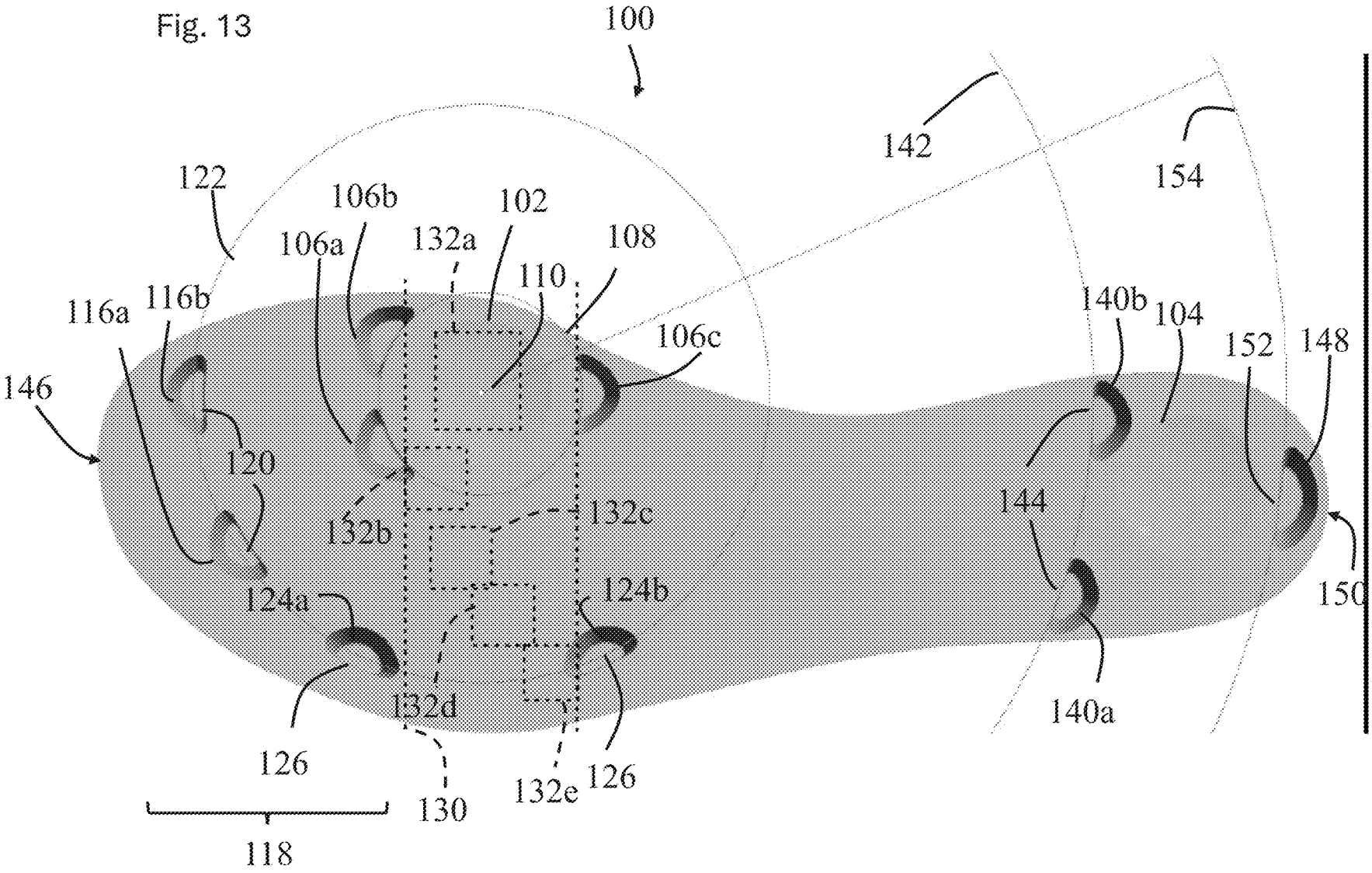
FIG. 13 is a bottom plan view of a cleated outsole for a soccer shoe or boot in accordance with yet another embodiment of the disclosure.
Figure 13A:
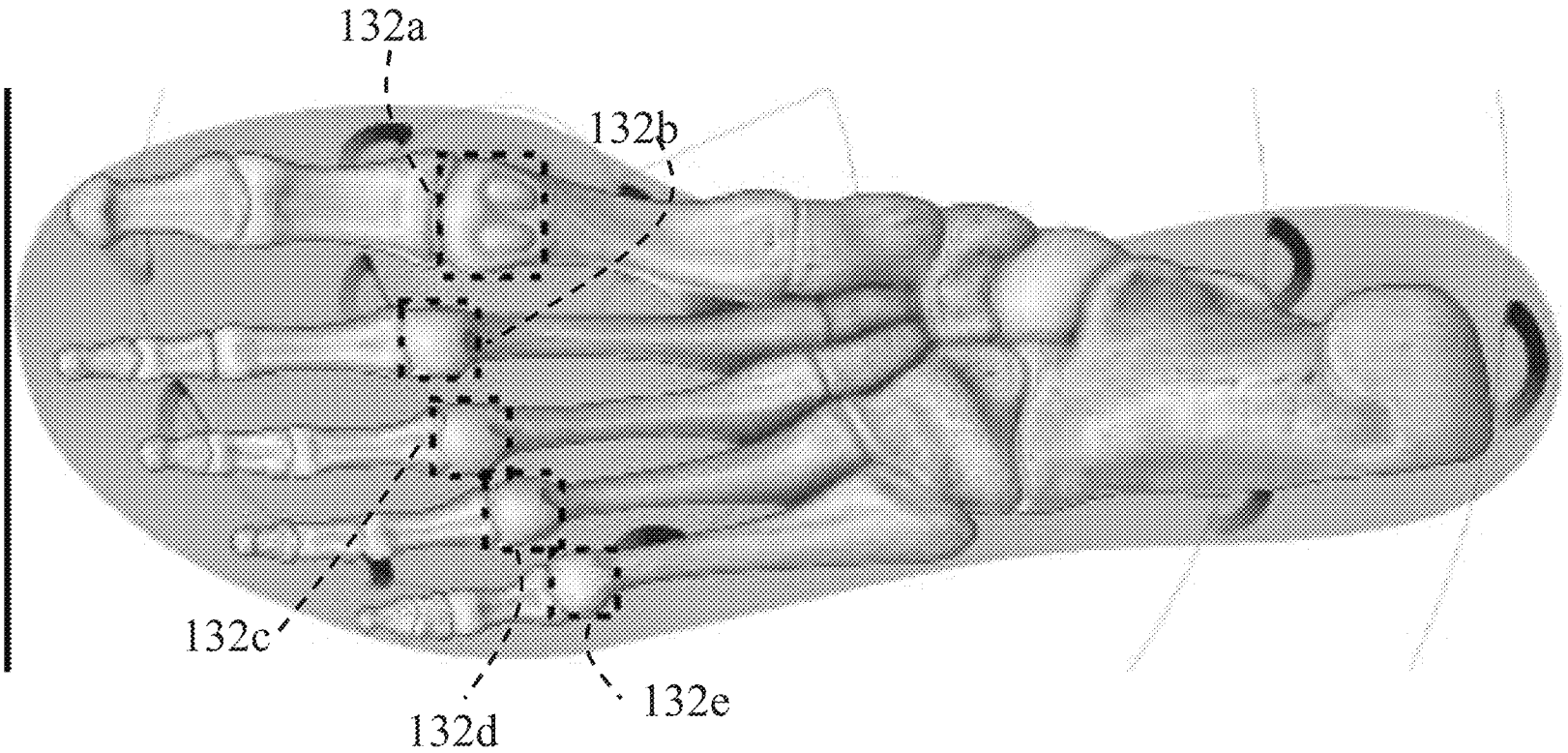
FIG. 13*a* is a bottom plan view of the soccer shoe or boot of FIG. 13, with boxes locating the metatarsal head joints of the bones of a human foot superimposed thereon.
Figure 14:
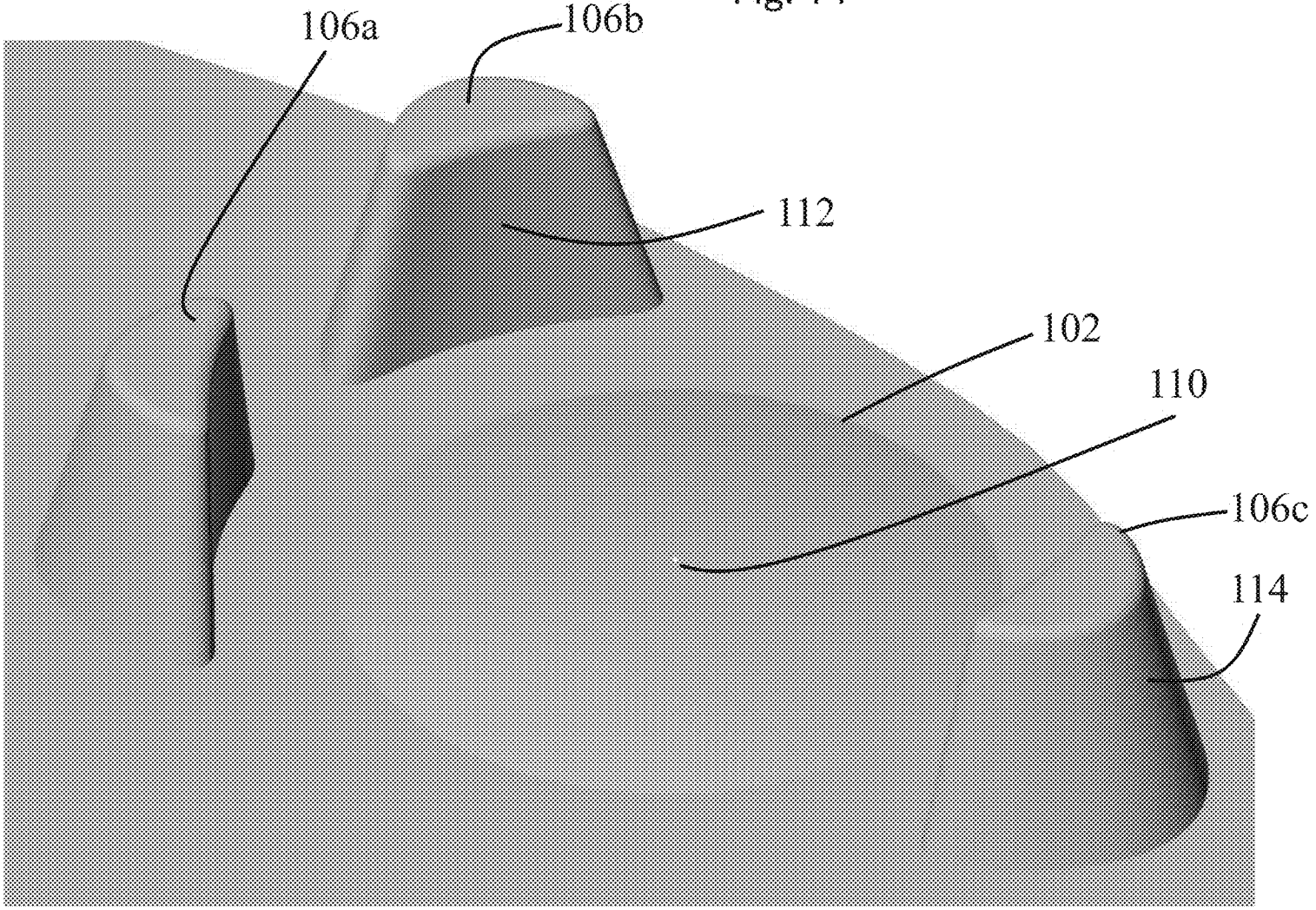
FIG. 14 is a perspective view of a portion of the cleated soccer shoe or boot of FIG. 13.

FIG. 13 is a bottom plan view of a cleated soccer boot outsole 100 in accordance with a further embodiment of the present disclosure, and FIG. 13*a* adds a bottom plan view of the bones of the foot, with boxes 132*a*-132*e* shown in phantom locating the metatarsal head joints shown in FIG. 13. FIG. 14 is an enlarged perspective view of a portion of the cleated outsole of FIG. 13, of the area of the outsole underlying the first metatarsal head of the wearer. Outsole 100 is similar to outsole 16 of FIG. 4 in that the outsole bottom surface includes a first convex surface or inverted dome 102 underlying a concave depression in the outsole upper surface (not shown) positioned to underlie the first metatarsal head of the wearer. Outsole 100 also includes a second surface or inverted dome 104 configured to underlie the heel of the wearer, i.e., similar to the FIG. 4 embodiment discussed above.

Figure 15:
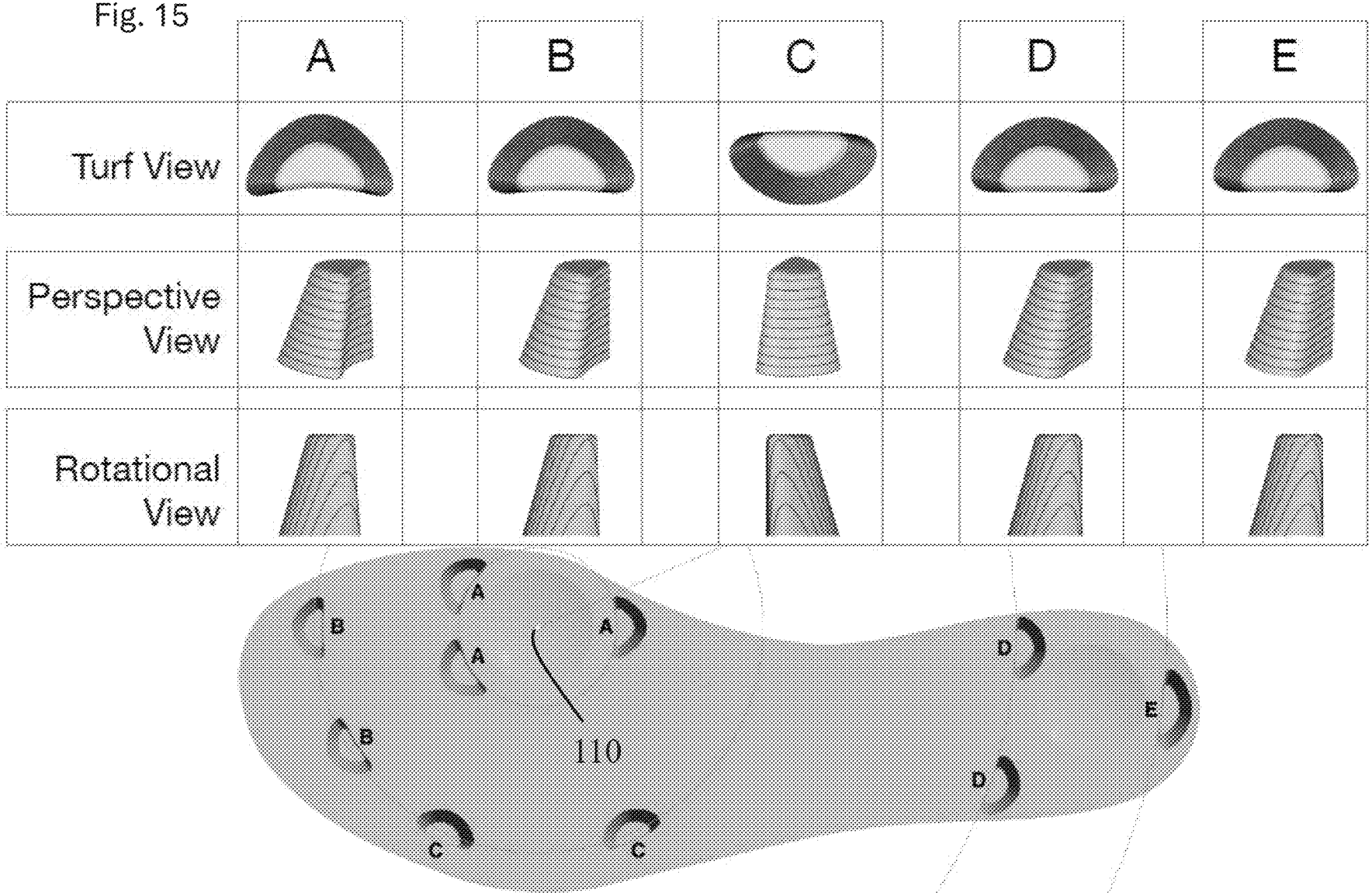
FIG. 15 shows the different geometries of the cleat or stud shapes of the soccer shoe or boot of FIG. 13.

A first plurality of cleats 106*a*, 106*b*, 106*c* are positioned essentially on a first radius 108 extending from a central point 110 of the first convex surface 102. Cleats 106*a*, 106*b*, 106*c* have a form of a truncated cone, essentially cut down the middle, and having a substantially perpendicular "flat" side surface 112 and a rounded slanted side surface 114. FIG. 15 shows the five (5) different cleat or stud geometries used to produce the outsole in FIG. 13. The "Turf View" row shows each stud shape used. The difference between cleat or stud A and cleat or stud B is the radius it is wrapped around to minimize rotational resistance around central point 110. The shape and orientation of cleats 106*a*, 106*b*, 106*c* are important since the substantially perpendicular flat side 112 of the cleats positioned on a radius as discussed below, effectively reduces resistance to rotational forces around point 110, while providing the strongest linear resistance force for traction perpendicular to the face 112, and less linear resistance force for traction in the opposite direction. Looking at the "Rotational View" in FIG. 15, the thin lines are 1 mm apart in the Z plane, providing a view much like a boat hull, which is a good analogy since we are reducing "drag" in the rotational direction while increasing "drag" in the linear direction. The amount of force can be "tuned" by adjusting the slope of sides 112 and 114, while potentially increasing rotational resistance of the cross-sectional area is excessively increased. Accordingly, the cleats 106*a*, 106*b*, 106*c* are arranged essentially on a first radius 108 surrounding convex surface 102 with their flat sides 112 essentially facing on the radius 108.

A second plurality of like half truncated cone shaped cleats 116*a*, 116*b*, are arranged in the toe section 118 of the outsole 100 with their flat sides 120 facing generally rearward and positioned essentially on a second radius 122 extending from central point 110 of the first convex surface 102, and a third plurality of like half truncated cone shaped cleats 124*a*, 124*b* are located essentially on the second radius 122 extended from central point 110 of the first convex surface 102, adjacent a lateral side of the outsole 100, with their flat faces 126 facing to the lateral side of the outsole 100.

In order to further facilitate plantarflexion and eversion of the metatarsals of the wearer while under load, an area of the outsole shown in phantom at 130 which underlies the metatarsal heads of the wearer, shown in phantom 132*a*, 132*b*, 132*c*, 132*d*, 132*e* is devoid of spikes.

A fourth plurality of like half truncated cone shaped cleats 140*a*, 140*b* are located essentially on a third radius 142 extending from central point 110 of the first convex surface 102, with their flat faces 144 facing toward the toe end 146 of the outsole 100 ahead of the second convex surface 104, and a further like half truncated cone shaped cleat 148 is located to the heel end 150 of the outsole 100, with its flat side 152 located essentially on a fourth radius 154 extending from central point 110 of the first convex surface 102.

A feature and advantage of our half truncated cone shaped cleats is that we can achieve essentially the same traction at the heel with three cleats rather than four, and at the same time reduce torque resistance by orienting the cleats with their perpendicular flat sides facing forward.

Various other changes may be made, without departing from the spirit and scope of the disclosure. By way of example, but not limitation, referring to FIGS. 2*f* and 2*g*, in one alternative embodiment, the insole 18 is provided with a depressed area 28 in the forward or forefoot region as above described, while the Strobel board or midsole 14 and the outsole 16 foot support surfaces are flat. Alternatively, referring to FIGS. 2*h* and 2*i*, in another embodiment, insole 18 includes a depressed area 28 in the forward or forefoot region configured to underlie the first metatarsal head of the wearer as above described, and a corresponding depressed area 44 is provided in the outsole 16, while the Strobel board or midsole 14 foot supporting surface is flat.

Figure 2J:
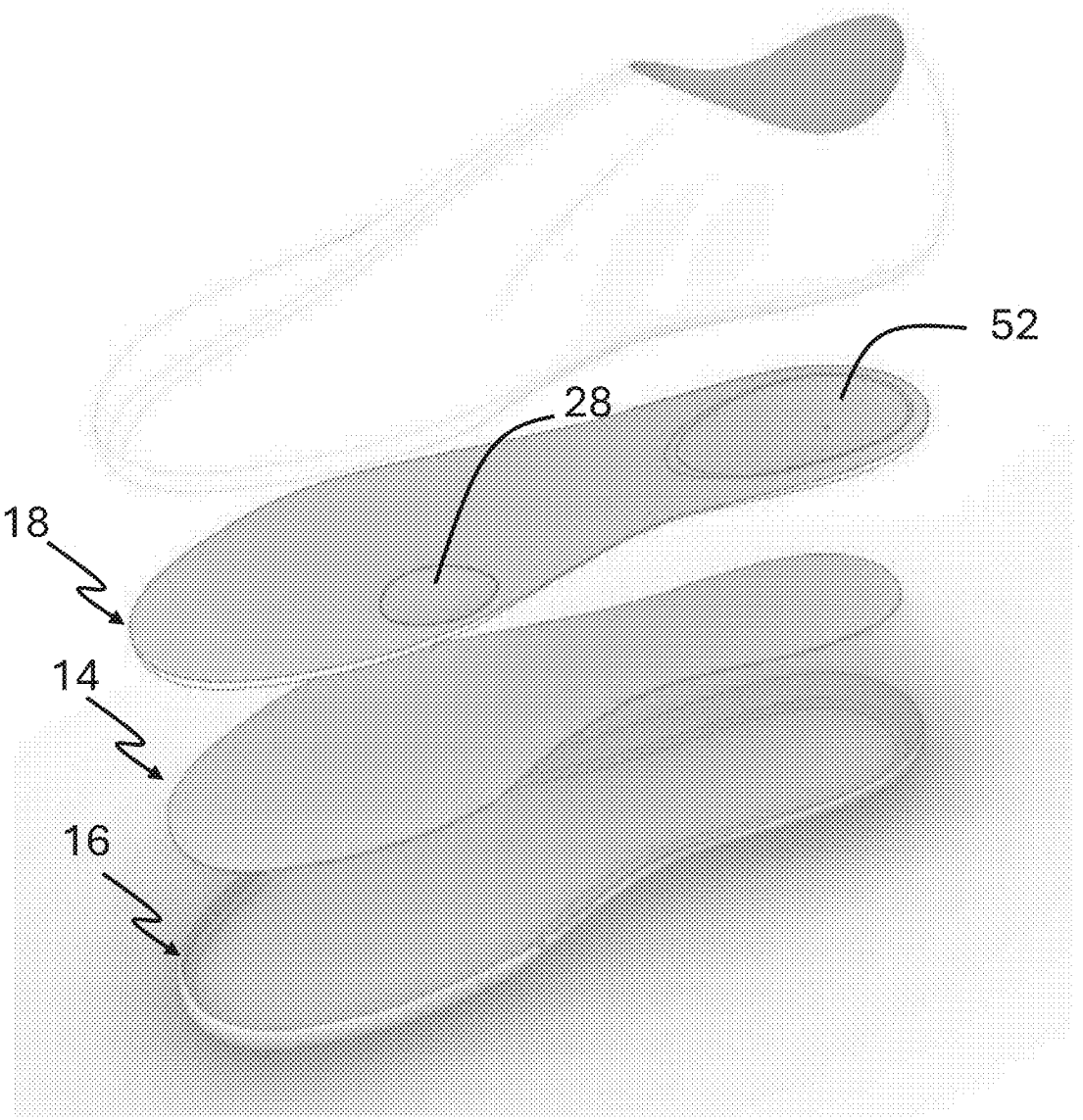
Figure 2K:
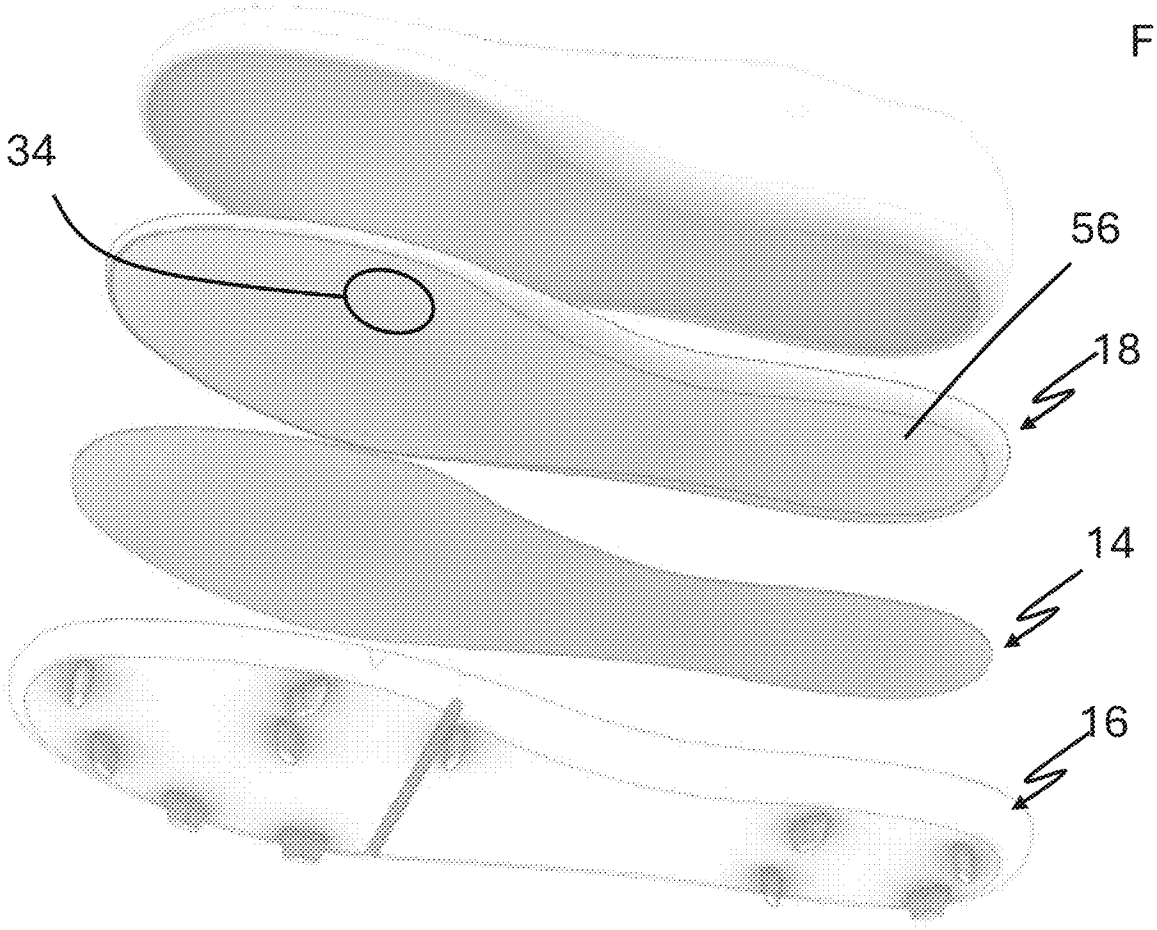
Figure 2L:
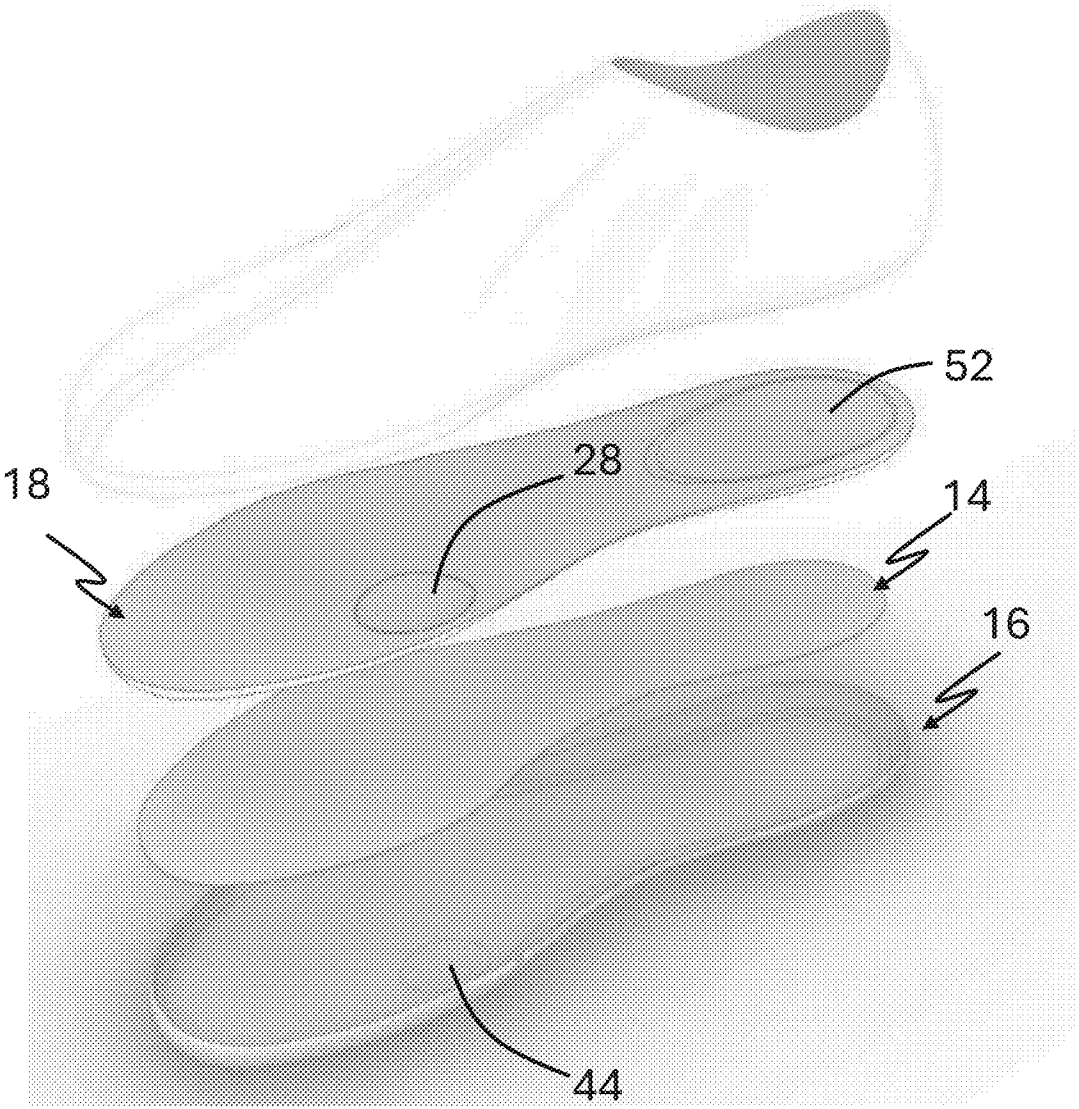
Figure 2M:
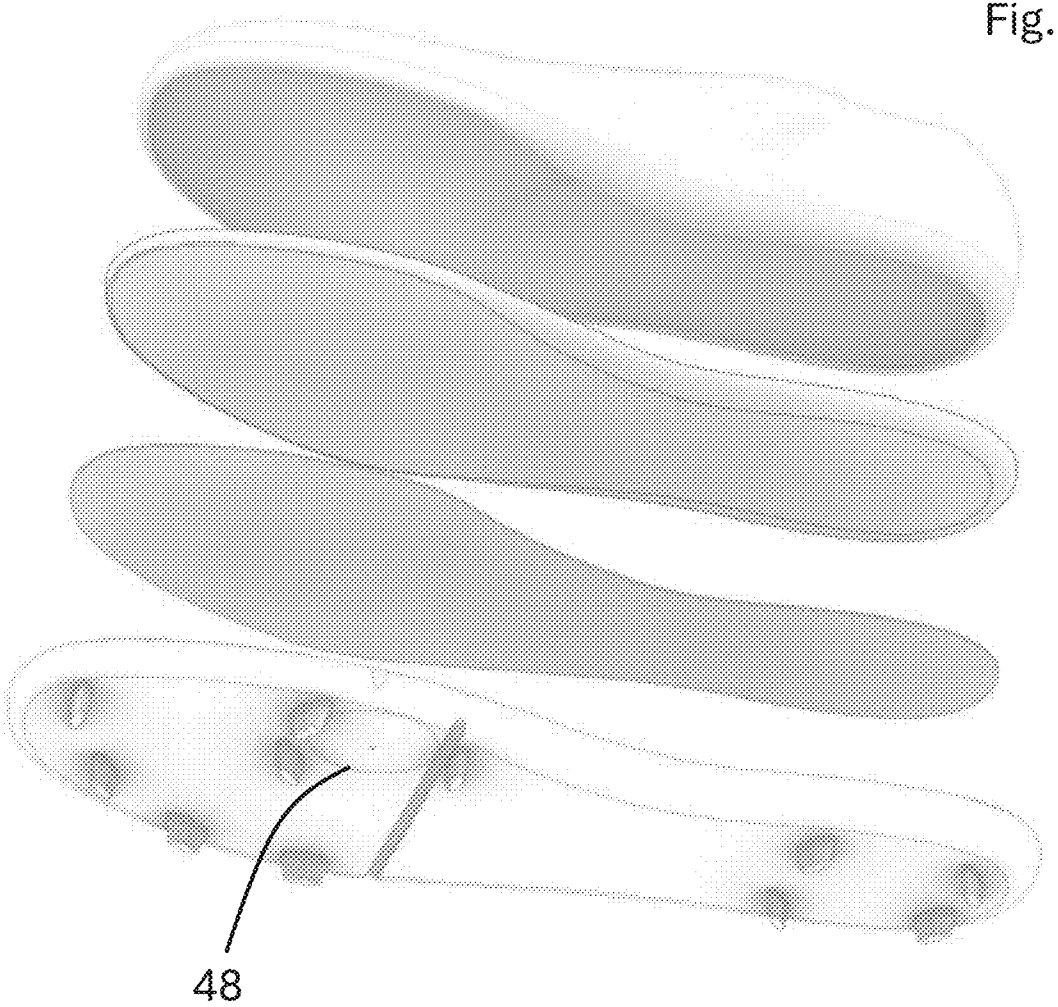

In still yet another embodiment, referring to FIGS. 2*j* and 2*k*, insole 18 is provided with an area of reduced support 28 configured to underlie the first metatarsal head as above described, and the heel area of the insole is provided with a depressed area 52 as above described, while the foot supporting surfaces of the Strobel board or midsole 14 and the outsole 16 are flat.

In still yet another embodiment of the disclosure, insole 18 is provided with an area of reduced support 28 configured to underlie the first metatarsal head of the wearer as above described, and also a depressed area 52 under the heel area as above described, while the outsole 16 is provided with a concave depression 44, while the Strobel board or midsole is flat. In all cases the cleat pattern in the forefoot section of the shoe is configured so that there are no cleats located directly under the foot supporting area of the shoe underlying the first metatarsal head of the wearer. That is to say, the first metatarsal head of the wearer is unloaded with respect to a cleat. Various other changes may be made without departing from the spirit and scope of the disclosure

LIST OF REFERENCES

10 spiked or cleated shoe
12 upper
14 Strobel board or midsole
16 outsole
18 insole
20 cleats or spikes

20A-20E cleats or spikes
22 forefoot region
24 first forefoot region
26 second forefoot region
28 depressed area
30 metatarsal head
32 metatarsal bone
34 dome
36 bottom surface
38 area
38*a* hole/hollow
40 convex surface
42 bottom surface
44 concave depression
46*a*-46*e* radius
48 convex surface
50 heel region
52 heel depression
53 heel cup/depression
56 convex heel surface
57 convex heel surface
57*a* through hole
58 concave heel depression
60 second convex surface
62 flex channel
68 first plurality of spikes or cleats
70 second plurality of spikes or cleats
71 third plurality of cleats
72 outside sidewall
74 flex notch
76 force
78 bottom surface
100 outsole
102 inverted dome
104 second inverted dome
106*a*-106*e* cleats
108 radius
110 central point
112 flat surface
114 slanted side surface
116*a*, 116*b* cleats
118 toe section
120 flat sides
122 second radius
124*a*, 124*b* cleats
126 flat faces
130 outsole area
132*a*-132*e* metatarsal heads
140*a*, 14*b* cleats
142 third radius
144 flat faces
146 toe end
148 cleat
150 heel end
152 flat side
154 fourth radius

What is claimed:

1. A cleated shoe comprising:

an upper, a Strobel board or midsole assembled to the upper, an insole, and an outsole assembled or bonded to the assembled upper and Strobel board or midsole, and having a plurality of cleats which are secured to or incorporated in the outsole, wherein the plurality of cleats have a shape of a truncated half cone having a substantially flat perpendicular side wall, and a slanted curved wall, wherein the insole has a forefoot region, having a first forefoot region configured to underlie heads of the second, third, fourth, and fifth metatarsal bones of a foot of a wearer, and a second forefoot region having a first concave depression extending downward from a top of the insole configured to underlie a head of the first metatarsal bone of the foot of the wearer and configured to isolate support of the head of the first metatarsal bone of the wearer from the second, third, fourth and fifth metatarsal heads whereby to permit the head of the first metatarsal bone of the wearer to drop or plantarflex and to evert while under load, wherein the outsole is devoid of cleats in an area underlying the first concave depression in the insole, and wherein the outsole has a first concave depression configured to underlie the first metatarsal head of the wearer and which is configured to extend as a first convex dome below a bottom surface of the outsole, and wherein a first plurality of said plurality of cleats are radially arranged on a first radius around a center point of the first convex dome.

2. The cleated shoe of claim 1, wherein the first plurality of said plurality of cleats are arranged with their substantially flat perpendicular side walls arranged on said first radius around the center point of the first convex dome.

3. The cleated shoe of claim 1, wherein the outsole has a second concave depression which is configured to underlie a heel of the wearer and is configured to extend as a second convex dome below the bottom surface of the outsole, and wherein a second plurality of said plurality of cleats are radially arranged adjacent said second convex dome of the outsole.

4. The cleated shoe of claim 3, wherein at least two of said second plurality of said plurality of cleats are arranged forward of said second convex dome on a second radius around the center point of the first convex dome with their substantially flat perpendicular side walls arranged on said second radius.

5. The cleated shoe of claim 3, wherein at least one of said second plurality of said plurality of cleats is arranged to a rear of said second convex dome with its substantially flat perpendicular side wall arranged on a third radius around the center point of the first convex dome.

6. The cleated shoe of claim 1, further comprising a third plurality of said plurality of cleats arranged around a fourth radius around the center point of said first convex dome, with at least two of said third plurality of said plurality of cleats having their substantially flat perpendicular side walls facing a lateral side of said outsole, and at least two of said third plurality of said plurality of cleats having their substantially flat perpendicular side walls facing the center point of said first convex dome.

7. The cleated shoe of claim 1, wherein the outsole has an area configured to underlie all five metatarsal heads of the foot of the wearer, which is devoid of cleats.

8. A pair of left and right foot cleated shoes as claimed in claim 1, wherein a left shoe and a right shoe are mirror images of one another.

9. The pair of cleated or spiked shoes as claimed in claim 8, wherein the shoes are selected from the group consisting of football boots, soccer boots, and rugby shoes.

10. A pair of cleated shoes as claimed in claim 1, wherein cleat patterns are different for left and right shoes, and wherein the shoes are selected from the group consisting of golf shoes, javelin shoes, discus shoes and shotput shoes.

11. The cleated or spiked shoe of claim 1, wherein the first concave depression of the insole is sized to accommodate the head of the first metatarsal bone of the wearer.

12. The cleated or spiked shoe of claim 11, wherein the first concave depression of the insole is circular in plan and has a diameter of between 2.54 cm and 3.81 cm.

13. The cleated or spiked shoe of claim 11, wherein the first concave depression of the insole has a nominal depth of 2-3 mm measured from a top edge of side wall bounding a depressed area to a lowest point of the depression.

14. The cleated or spiked shoe of claim 1, wherein the first concave depression of the insole is oval, egg-shaped or elongated in plan.

15. A cleated shoe comprising:

an upper, a Strobel board or midsole assembled to the upper, an insole, and an outsole assembled or bonded to the assembled upper and Strobel board or midsole, and having a plurality of cleats which are secured to or incorporated in the outsole, wherein the plurality of cleats have a shape of a truncated half cone having a substantially flat perpendicular side wall, and a slanted curved wall, wherein the insole has a forefoot region, having a first forefoot region configured to underlie heads of the second, third, fourth, and fifth metatarsal bones of a foot of a wearer, and a second forefoot region having a first concave depression extending downward from a top of the insole configured to underlie a head of the first metatarsal bone of the foot of the wearer and configured to isolate support of the head of the first metatarsal bone of the wearer from the second, third, fourth and fifth metatarsal heads whereby to permit the head of the first metatarsal bone of the wearer to drop or plantarflex and to evert while under load, wherein the outsole is devoid of cleats in areas configured to underlie the heads of the first, second, third, fourth and fifth metatarsal bones of the foot of the wearer, and wherein the outsole has a first concave depression configured to underlie the first metatarsal head of the wearer and which is configured to extend as a first convex dome below a bottom surface of the outsole, and wherein a first plurality of said cleats are radially arranged on a first radius around a center point of the first convex dome.

16. The cleated shoe of claim 15, wherein the plurality of cleats are arranged with their substantially flat perpendicular side walls arranged on said first radius around the center point of the first convex dome.

17. The cleated shoe of claim 15, wherein the outsole has a second concave depression which is configured to underlie a heel of the wearer and is configured to extend as a second convex dome below the bottom surface of the outsole, and wherein a second plurality of said cleats are radially arranged adjacent said second convex dome of the outsole.

18. The cleated shoe of claim 17, wherein at least two of said second plurality of said cleats are arranged forward of said second convex dome on a second radius around the center point of the first convex dome with their substantially flat perpendicular side walls arranged on said second radius.

19. The cleated shoe of claim 17, wherein at least one of said second plurality of cleats is arranged to a rear of said second convex dome with its substantially flat perpendicular side wall arranged on a third radius around the center point of the first convex dome.

20. The cleated shoe of claim 15, further comprising a third plurality of said plurality of cleats arranged around a fourth radius around the center point of said first convex dome, with at least two of said third plurality having their substantially flat perpendicular side walls facing a lateral side of said outsole, and at least two of said third plurality having their substantially flat perpendicular side walls facing the center point of said first convex dome.

21. The cleated shoe of claim 15, wherein the outsole has an area configured to underlie all five metatarsal heads of the foot of the wearer, which is devoid of cleats.

22. A pair of left and right foot cleated shoes as claimed in claim 15, wherein a left shoe and a right shoe are mirror images of one another.

23. The pair of cleated or spiked shoes as claimed in claim 22, wherein the shoes are selected from the group consisting of football boots, soccer boots, and rugby shoes.

24. A pair of cleated shoes as claimed in claim 15, wherein cleat patterns are different for left and right shoes, and wherein the shoes are selected from the group consisting of golf shoes, javelin shoes, discus shoes and shotput shoes.

25. The cleated or spiked shoe of claim 15, wherein the first concave depression of the insole is sized to accommodate the head of the first metatarsal bone of the wearer.

26. The cleated or spiked shoe of claim 25, wherein the first concave depression of the insole is circular in plan and has a diameter of between 2.54 cm and 3.81 cm.

27. The cleated or spiked shoe of claim 25, wherein the first concave depression of the insole has a nominal depth of 2-3 mm measured from a top edge of side wall bounding a depressed area to a lowest point of the depression.

28. The cleated or spiked shoe of claim 15, wherein the first concave depression of the insole is oval, egg-shaped or elongated in plan.

* * * * *